US010583657B2

(12) United States Patent
Sugiura

(10) Patent No.: US 10,583,657 B2
(45) Date of Patent: Mar. 10, 2020

(54) LIQUID JETTING APPARATUS

(71) Applicant: Brother Kogyo Kabushiki Kaisha, Nagoya-shi, Aichi-ken (JP)

(72) Inventor: Keita Sugiura, Toyokawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/130,331

(22) Filed: Sep. 13, 2018

(65) Prior Publication Data

US 2019/0084303 A1 Mar. 21, 2019

(30) Foreign Application Priority Data

Sep. 20, 2017 (JP) ..... 2017-179821

(51) Int. Cl.
*B41J 2/14* (2006.01)
*B41J 2/175* (2006.01)
*B41J 2/055* (2006.01)

(52) U.S. Cl.
CPC ..... *B41J 2/1433* (2013.01); *B41J 2/055* (2013.01); *B41J 2/14209* (2013.01); *B41J 2/14233* (2013.01); *B41J 2/17563* (2013.01); *B41J 2002/14225* (2013.01); *B41J 2002/14306* (2013.01); *B41J 2002/14403* (2013.01);
(Continued)

(58) Field of Classification Search
CPC .. B41J 2/1433; B41J 2/14233; B41J 2/17563; B41J 2002/14459; B41J 2202/12; B41J 2002/14225; B41J 2002/14306; B41J 2002/14403; B41J 2002/14419;
(Continued)

(56) References Cited

U.S. PATENT DOCUMENTS 5,087,931 A 2/1992 Rawson
9,688,076 B2 6/2017 Sugahara et al.
(Continued)

FOREIGN PATENT DOCUMENTS

EP 3162567 A1 5/2017
JP 2015-182253 A 10/2015
(Continued)

OTHER PUBLICATIONS

Feb. 14, 2019—(EP) Extended Search Report—App 18194635.1.

*Primary Examiner* — Huan H Tran
*Assistant Examiner* — Alexander D Shenderov
(74) *Attorney, Agent, or Firm* — Banner & Witcoff, Ltd.

(57) ABSTRACT

A liquid jetting apparatus includes individual channel rows each formed by individual channels aligned in a first direction and including nozzles respectively, the individual channel rows being arranged in a second direction orthogonal to the first direction, first manifolds each extending in the first direction and connected to the individual channels, the first manifolds being arranged in the second direction, and at least one second manifold extending in the first direction and connected to the individual channels. First connecting ports are formed in end portions, of the first manifolds, on one side in the first direction and open on one side in a third direction orthogonal to both the first direction and the second direction. A second connecting port is formed in an end portion, of the second manifold, on the one side in the first direction and open on the one side in the third direction.

25 Claims, 10 Drawing Sheets

(52) U.S. Cl.
CPC ..... *B41J 2002/14419* (2013.01); *B41J 2002/14459* (2013.01); *B41J 2202/11* (2013.01); *B41J 2202/12* (2013.01)

(58) Field of Classification Search
CPC .... B41J 2202/11; B41J 2/055; B41J 2/14209; B41J 2/01
USPC ..... 347/84
See application file for complete search history.

(56) References Cited

U.S. PATENT DOCUMENTS

| | | | | |
|---|---|---|---|---|
| 9,950,538 | B2 | 4/2018 | Sugahara et al. | |
| 2004/0113996 | A1* | 6/2004 | Boyd | B41J 2/14024 347/85 |
| 2006/0066652 | A1 | 3/2006 | Sugahara | |
| 2008/0030553 | A1 | 2/2008 | Takahashi | |
| 2008/0143793 | A1 | 6/2008 | Okuda | |
| 2011/0085012 | A1 | 4/2011 | Nishikawa et al. | |
| 2012/0160925 | A1 | 6/2012 | Hoisington et al. | |
| 2015/0306875 | A1* | 10/2015 | Nishimura | B41J 2/1433 347/71 |
| 2016/0288499 | A1 | 10/2016 | Sugahara et al. | |
| 2017/0253037 | A1 | 9/2017 | Kobayashi | |
| 2017/0259579 | A1 | 9/2017 | Sugahara et al. | |
| 2018/0117911 | A1 | 5/2018 | Hayashi | |

FOREIGN PATENT DOCUMENTS

| | | | |
|---|---|---|---|
| JP | 2016-190431 | A | 11/2016 |
| WO | 2015/022833 | A1 | 2/2015 |

* cited by examiner

LIQUID JETTING APPARATUS

CROSS REFERENCE TO RELATED APPLICATION

The present application claims priority from Japanese Patent Application No. 2017-179821, filed on Sep. 20, 2017, the disclosure of which is incorporated herein by reference in its entirety.

BACKGROUND

Field of the Invention

The present invention relates to a liquid jetting apparatus configured to jet liquid from nozzles.

Description of the Related Art

In the printer described in Japanese Patent Application Laid-open No. 2016-190431, eight nozzle rows are formed in an ink jet head to align in a scanning direction. Further, in correspondence with that, in the ink jet head, four manifolds are formed to align in the scanning direction. Each of the manifolds extends in a conveyance direction to connect to a plurality of ink channels corresponding to two adjacent nozzle rows along the scanning direction. The four manifolds are constructed of two first manifolds aligning in the scanning direction at an interval and two second manifolds aligning in the scanning direction and being positioned between the two first manifolds. The first manifolds are supplied with an ink from ink supply ports provided at the upstream side along the conveyance direction, and the ink flows downstream from the upstream side in the conveyance direction. The second manifolds are connected to the first manifolds in downstream end portions along the conveyance direction, and the ink flows upstream from the downstream side in the conveyance direction and is then discharged from ink discharge ports provided in upstream end portions along the conveyance direction. Further, the ink supply ports and the ink discharge ports are at the same position in the conveyance direction and, between the two ink supply ports, the two ink discharge ports are arranged.

SUMMARY

In the ink jet head described in Japanese Patent Application Laid-open No. 2016-190431, the flowing ink is different in color between the two manifolds on the right and the two manifolds on the left among the four manifolds. Therefore, neither are the two ink supply ports connected to a common channel nor are the two ink discharge ports connected to another common channel. On the other hand, it is possible to use the ink jet head described in Japanese Patent Application Laid-open No. 2016-190431 as an ink jet head jetting an ink of only one color. Hence, in such a case, it is considered to connect the two ink supply ports to a common channel and connect the two discharge ports to another common channel.

In the ink jet head described in Japanese Patent Application Laid-open No. 2016-190431, the two ink discharge ports are arranged between the two adjacent ink supply ports. Therefore, it is necessary to arrange the common channel to the two ink supply ports to keep off the ink discharge ports above the ink jet head. Hence, the common channel to the two ink supply ports becomes complicated in structure.

Here, in order to simplify the structures of the common channel to the two ink supply ports and the common channel to the two ink discharge ports, for example, it is considered to make a grade separated crossing between the two second manifolds and one of the two first manifolds in the vicinity of an upstream end portion along the conveyance direction, in the ink jet head described in Japanese Patent Application Laid-open No. 2016-190431, so as to switch the positions along the scanning direction. In this manner, it is possible to arrange the two ink supply ports and the two ink discharge ports to locate respectively adjacent in the scanning direction, so as to simplify the structures of the aforementioned common channels. In this case, however, because it is necessary to make a grade separated crossing between the manifolds, the manifolds in the ink jet head become complicated in structure.

An object of the present teaching is to provide a liquid jetting apparatus having a simple channel structure.

According to an aspect of the present teaching, there is provided a liquid jetting apparatus including:

individual channel rows each formed by individual channels, the individual channels being aligned in a first direction and including nozzles respectively, the individual nozzle rows being arranged in a second direction orthogonal to the first direction;

first manifolds each extending in the first direction and connected to the individual channels forming the individual channel rows, the first manifolds being arranged in the second direction; and at least one second manifold extending in the first direction and connected to the individual channels forming the individual channel rows, wherein first connecting ports are formed in end portions, of the first manifolds, on one side in the first direction, the first connecting ports opening on one side in a third direction orthogonal to both the first direction and the second direction, a second connecting port is formed in an end portion, of the at least one second manifold, on the one side in the first direction, the second connection port opening on the one side in the third direction, the first connecting ports and the second connecting port are arranged to be shifted in the first direction, and the liquid jetting apparatus further comprises a first common channel extending in the second direction and connected to the first connecting ports of the first manifolds.

DESCRIPTION OF THE EMBODIMENTS

A couple of embodiments of the present teaching will be explained below.

<Overall Configuration of Printer 1>

Figure 1:
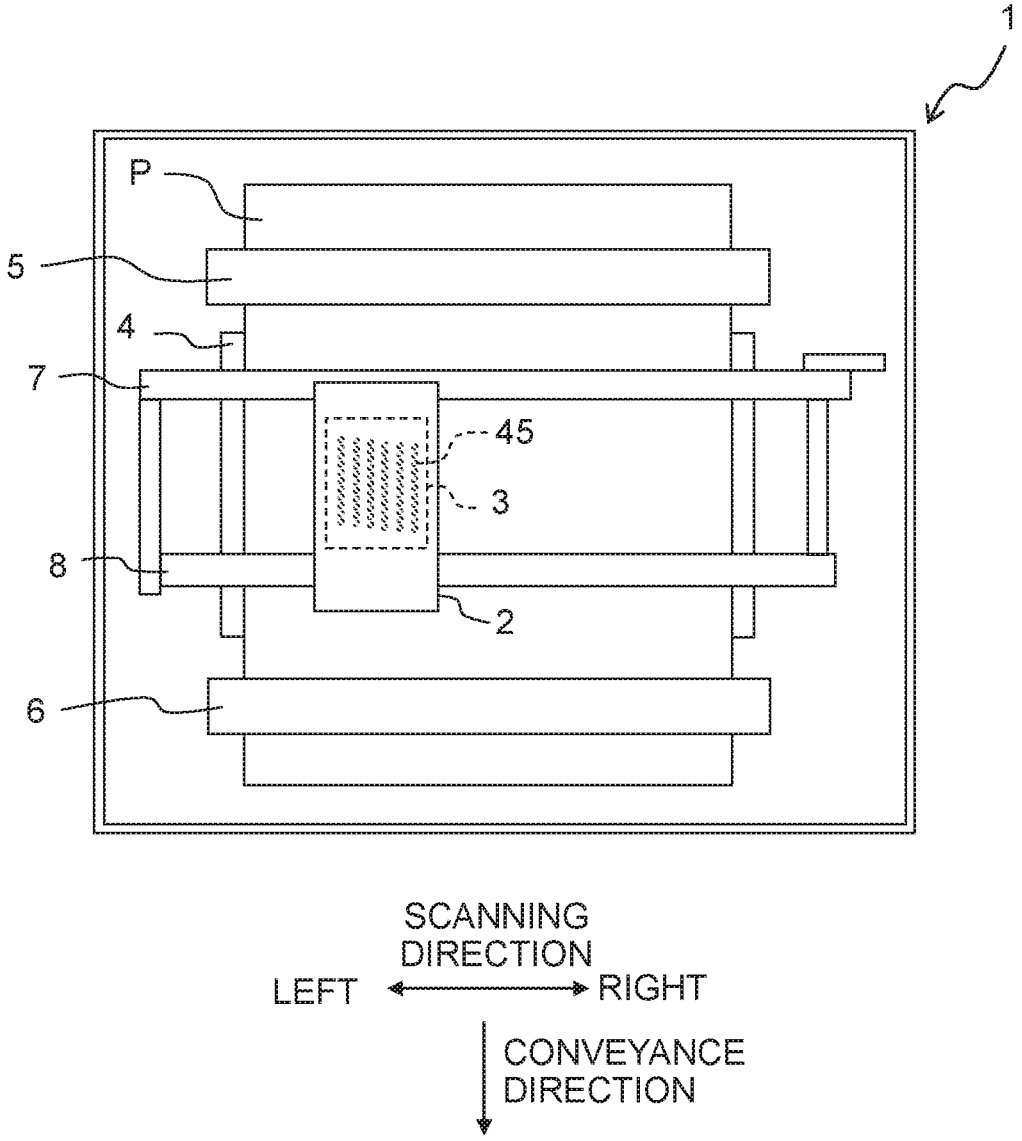
FIG. 1 is a schematic configuration diagram of a printer according to a first embodiment of the present teaching.

As depicted in FIG. 1, a printer 1 according to a first embodiment of the present teaching includes a carriage 2, an ink jet head 3 (the "liquid jetting apparatus" of the present teaching), a platen 4, and conveyance rollers 5 and 6.

The carriage 2 is supported by two guide rails 7 and 8 extending in a scanning direction to move in the scanning direction along the guide rails 7 and 8. Further, as depicted in FIG. 1, the following explanation will be made with the right side and the left side being defined along the scanning direction.

The ink jet head 3 is mounted on the carriage 2 to move together with the carriage 2 in the scanning direction. Further, the ink jet head 3 jets an ink from a plurality of nozzles 45 formed in its lower surface. Further, a detailed explanation will be made later on about the ink jet head 3.

The platen 4 is arranged to face the lower surface of the ink jet head 3 and to extend across the entire length of recording paper P along the scanning direction. The platen 4 supports the recording paper P from below. The conveyance rollers 5 and 6 are arranged respectively at the upstream side and the downstream side with respect to the carriage 2 along a conveyance direction orthogonal to the scanning direction, to convey the recording paper P in the conveyance direction.

Then, the printer 1 carries out printing by causing the conveyance rollers 5 and 6 to convey the recording paper P through a predetermined distance and, each time the recording paper P is conveyed, moving the carriage 2 in the scanning direction while jetting the ink from the plurality of nozzles 45 of the ink jet head 3.

Note that the scanning direction corresponds to the "second direction" of the present teaching. Further, the conveyance direction corresponds to the "first direction" of the present teaching, and the upstream side and the downstream side along the conveyance direction correspond respectively to the "one side of the first direction" and the "other side of the first direction". Further, an up/down direction orthogonal to both the scanning direction and the conveyance direction corresponds to the "third direction" of the present teaching, and the upper side along the up/down direction corresponds to the "one side of the third direction" of the present teaching.

<Ink Jet Head 3>

Figure 2:
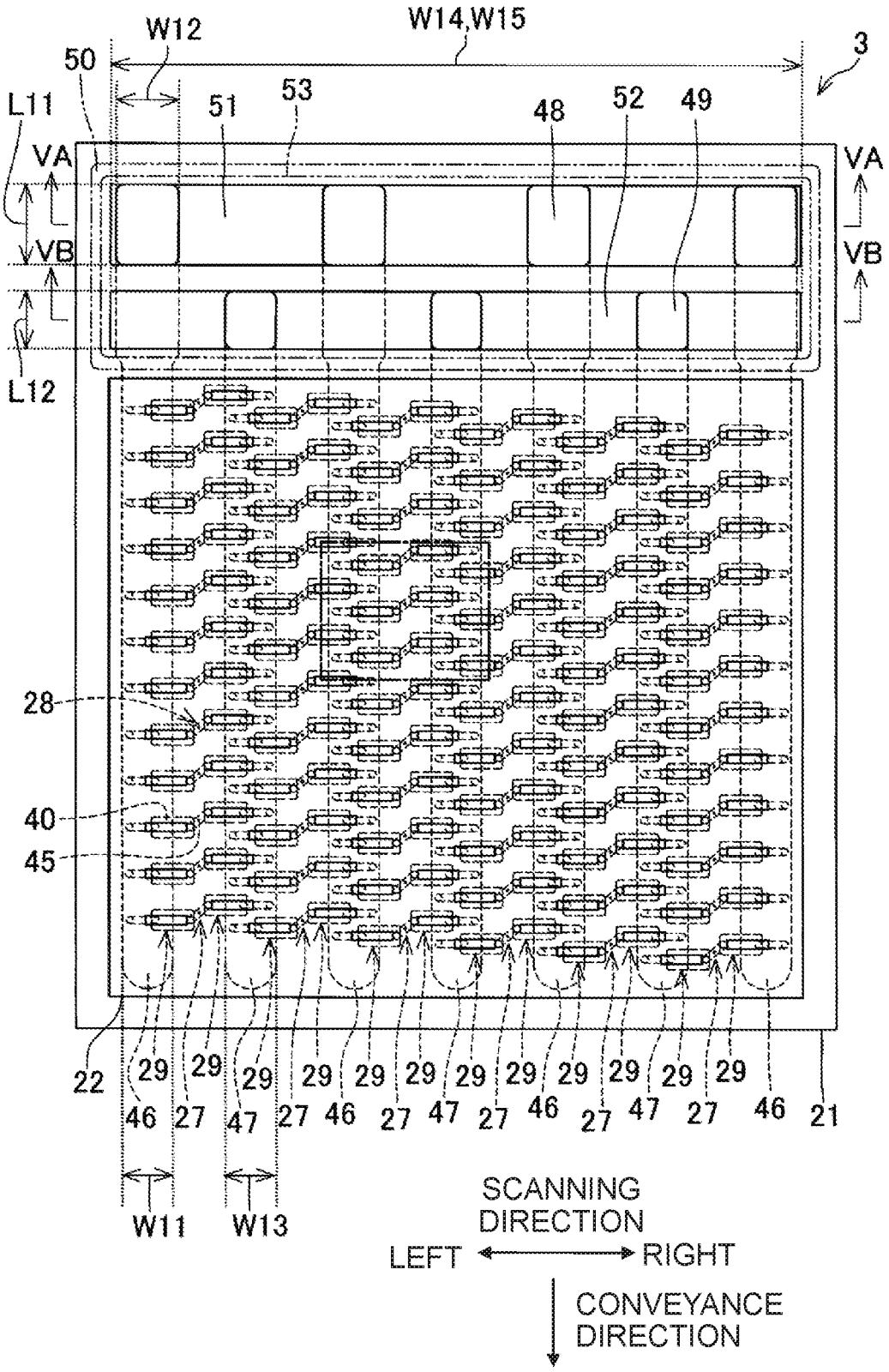
FIG. 2 is a plan view of an ink jet head depicted in FIG. 1.
Figure 3:
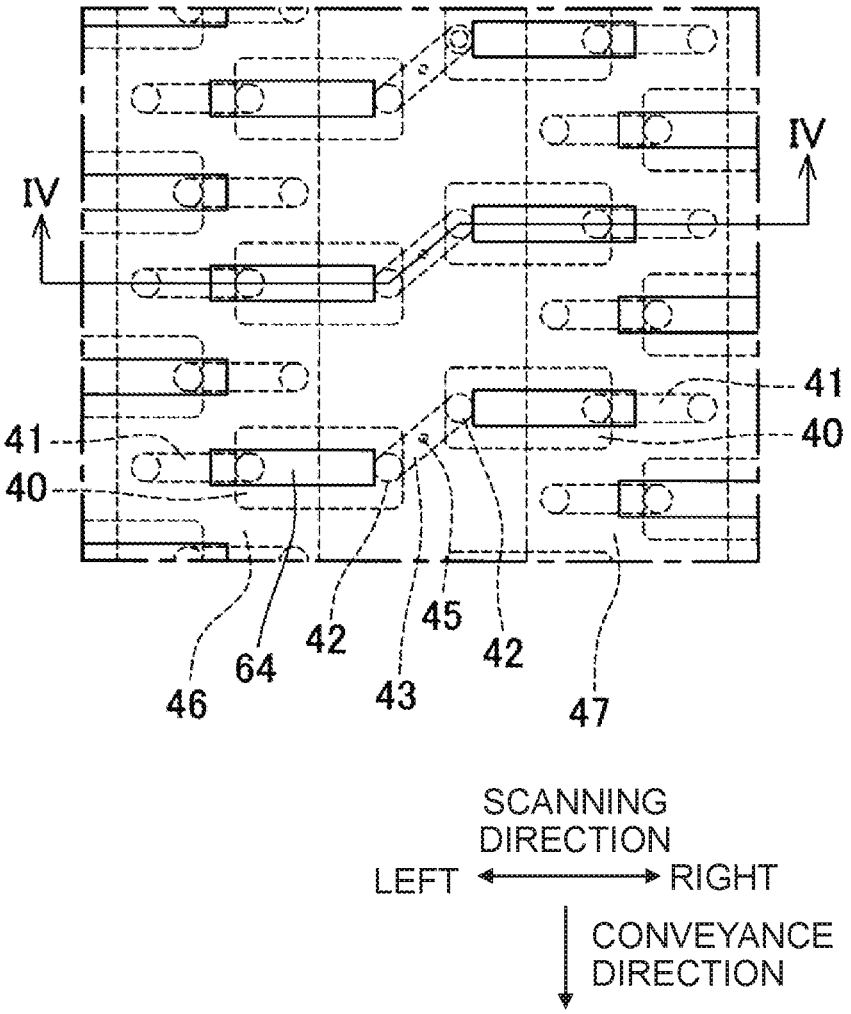
FIG. 3 is an enlarged view of a part encircled with a chain line in FIG. 2.
Figure 4:
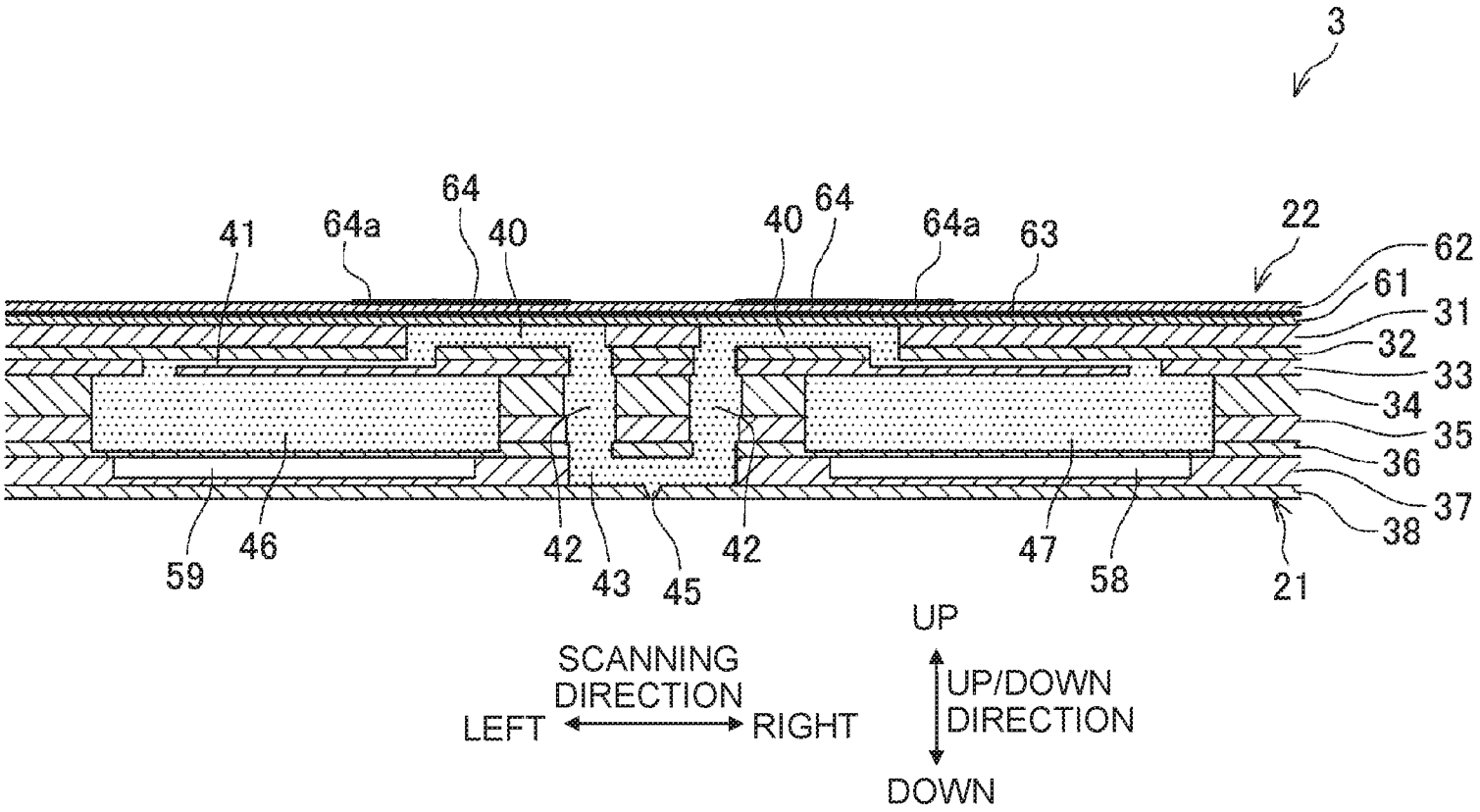
FIG. 4 is a cross-sectional view along the line IV-IV of FIG. 3.

Next, the ink jet head 3 will be explained in detail. As depicted in FIGS. 2 to 4, the ink jet head 3 includes a channel unit 21 formed with ink channels such as the nozzles 45, aftermentioned pressure chambers 40 and the like, and a piezoelectric actuator 22 applying pressure to the ink inside the pressure chambers 40.

<Channel Unit 21>

The channel unit 21 is formed by stacking eight plates 31 to 38 from above in the order of the plate numbers. The channel unit 21 is formed therein with the plurality of pressure chambers 40, a plurality of throttle channels 41, a plurality of descender channels 42 (the "connecting channel" of the present teaching), a plurality of link channels 43, the plurality of nozzles 45, four supply manifolds 46 (the "first manifold" of the present teaching), three feedback manifolds 47 (the "second manifold" of the present teaching).

The plurality of pressure chambers 40 are formed in the plate 31. Each of the pressure chambers 40 has an approximately rectangular planar shape with the scanning direction as its longitudinal direction. Further, the plurality of pressure chambers 40 are arrayed in the conveyance direction to form pressure chamber rows 29. Further, twelve of the pressure chamber rows 29 are aligned along the scanning direction in the plate 31. Further, between the pressure chamber rows 29, the pressure chambers 40 deviate in position along the conveyance direction.

The plurality of throttle channels 41 are formed across the plates 32 and 33. Each of the pressure chambers 40 is provided individually with a throttle channel 41. The throttle channels 41 provided for the pressure chambers 40 forming an odd numbered row from the left are connected to the left ends of the pressure chambers 40 and extend leftward from the connected parts with the pressure chambers 40. The throttle channels 41 provided for the pressure chambers 40 forming an even numbered row from the left are connected to the right ends of the pressure chambers 40 and extend rightward from the connected parts with the pressure chambers 40.

The plurality of descender channels 42 are formed of overlapping through holes formed in the plates 32 to 37 in the up/down direction. Each of the pressure chambers 40 is provided individually with a descender channel 42. The descender channels 42 provided for the pressure chambers 40 forming an odd numbered row from the left are connected to the right ends of the pressure chambers 40 and extend downward from the connected parts with the pressure chambers 40. The descender channels 42 provided for the pressure chambers 40 forming an even numbered row from the left are connected to the left ends of the pressure chambers 40 and extend downward from the connected parts with the pressure chambers 40.

The plurality of link channels 43 are formed in the plate 37. The link channels 43 extend horizontally in a direction inclined with respect to both the scanning direction and the conveyance direction. The link channels 43 connect the lower ends of the descender channels 42 connected to the pressure chambers 40 forming one of two adjacent pressure chamber rows 29 and the lower ends of the descender channels 42 connected to the pressure chambers 40 forming the other of the pressure chamber rows 29. To explain in more detail, the plate 37 is formed therein with through holes integrating the parts forming the abovementioned two descender channels 42 with the parts forming the link channels 43.

The plurality of nozzles 45 are formed in the plate 38. Each of the link channels 43 is provided individually for a nozzle 45 which is connected to a central portion of the link channel 43.

Then, in the channel unit 21, each individual channel 28 is formed from one nozzle 45, one link channel 43 connected to that nozzle 45, two descender channels 42 connected to that link channel 43, two pressure chambers 40 connected to those two descender channels 42, and two throttle channels 41 connected to those two pressure chambers 40. Further, the plurality of individual channels 28 are arrayed in the conveyance direction to form individual channel rows 27. Further, in the channel unit 21, six rows of the individual channel rows 27 are formed to align along the scanning direction.

Four supply manifolds 46 are formed by vertically overlapping the through holes formed in the plates 34 and 35 with the recesses formed in an upper part of the plate 36. The four supply manifolds 46 extend respectively in the conveyance direction to align in the scanning direction at intervals. Then, the four supply manifolds 46 are connected respectively with the ends of the throttle channels 41 at the far side from the pressure chambers 40, the throttle channels 41 being connected to the pressure chambers 40 forming the first, fourth, fifth, eighth, ninth, and twelfth pressure chamber rows 29 from the left.

Further, the supply manifolds 46 have a large length along the scanning direction in the parts positioned on the upstream side from the connected parts with the individual channels 28 at the upmost stream side along the conveyance direction. In particular, the supply manifolds 46 have a length W12 (>W11) along the scanning direction in the upstream parts along the conveyance direction from such parts having the length W11 along the scanning direction as including the connected parts with the plurality of individual channels 28.

Further, each of the supply manifolds 46 extends in the up/down direction across the plates 32 to 36 at the upstream end along the conveyance direction and is provided with an inflow port 48 (the "first connecting port" of the present teaching) in its upper end portion. Further, in correspondence with that, the plate 31 is formed with a common inflow channel 51 (the "common channel" or the "first common channel" of the present teaching) extending in the scanning direction across the inflow ports 48 of the four supply manifolds 46 to connect the inflow ports 48 with each other.

The three feedback manifolds 47 are formed by vertically overlapping the through holes formed in the plates 34 and 35 with the recesses formed in the upper part of the plate 36. Each of the three feedback manifolds 47 extends in the conveyance direction and is arranged between adjacent supply manifolds along the scanning direction. Then, the three feedback manifolds 47 are connected respectively with the ends of the throttle channels 41 at the far side from the pressure chambers 40, the throttle channels 41 being connected to the pressure chambers 40 forming the second, third, sixth, seventh, tenth, and eleventh pressure chamber rows 29 from the left.

Further, the feedback manifolds 47 have a constant length W13 along the scanning direction, independent from the position along the conveyance direction. The length W13 is the same as the aforementioned length W11, which is smaller than the aforementioned length W12. By virtue of this, the supply manifolds 46 have a larger area of the cross section orthogonal to the conveyance direction than the feedback manifolds 47 in the parts positioned on the upstream side from the connected parts with the individual channels 28 on the upmost stream side along the conveyance direction.

Further, each of the feedback manifolds 47 extends in the up/down direction across the plates 32 to 35 at the upstream end along the conveyance direction and is provided with an outflow port 49 (the "second connecting port" of the present teaching) in its upper end portion. Further, in correspondence with that, the plate 31 is formed with a common outflow channel 52 (the "second common channel" of the present teaching) extending in the scanning direction across the outflow ports 49 of the three feedback manifolds 47 to connect the outflow ports 49 with each other.

Further, the supply manifolds 46 extend farther to the upstream side along the conveyance direction than the feedback manifolds 47. By virtue of this, the inflow ports 48 are positioned on the upstream side from the outflow ports 49 along the conveyance direction. That is, the inflow ports 48 and the outflow ports 49 are arranged to deviate from each other along the conveyance direction.

Here, the length W14 of the common inflow channel 51 along the scanning direction is the same as the length W15 of the common outflow channel 52 along the conveyance direction. On the other hand, the length L11 of the common inflow channel 51 along the conveyance direction is larger than the length L12 of the common outflow channel 52 along the conveyance direction. By virtue of this, the common inflow channel 51 has a larger area of the cross section orthogonal to the up/down direction than the common outflow channel 52. Note that with the four supply manifolds 46 and the three feedback manifolds 47, considering the equalization of channel resistance, it is desirable to let the ratio between the length L11 of the common inflow channel 51 along the conveyance direction and the length L12 of the common outflow channel 52 along the conveyance direction be equal to the ratio between the number of the supply manifolds 46 and the number of the feedback manifolds 47.

Further, with the four supply manifolds 46 and the three feedback manifolds 47 arranged in the above manner, the supply manifolds 46 and the feedback manifolds 47 are aligned alternately in the scanning direction. Further, among the supply manifolds 46 and the feedback manifolds 47 aligned alternately in the scanning direction, the two manifolds positioned at the two opposite ends in the scanning direction are supply manifolds 46.

Further, on the upper surface of the channel unit 21, a filter member 50 is arranged to extend across the common inflow channel 51 and the common outflow channel 52. Further, in the first embodiment, such a part of the filter member 50 as overlapping with the common inflow channel 51 corresponds to the "first filter" of the present teaching, while the part overlapping with the common outflow channel 52 corresponds to the "second filter" of the present teaching. Further, on the upper surface of the channel unit 21 where the filter member 50 is arranged, a channel member 53 is arranged in the part overlapping with the common inflow channel 51 and the common outflow channel 52.

The channel member 53 is formed with channels 54 to 57. The channels 54 and 55 extend respectively in the scanning direction through the entire length of the common inflow channel 51 and common outflow channel 52. The channels 56 and 57 are connected respectively to central portions of the channels 54 and 55 along the scanning direction to extend upward from the connected parts with the channels 54 and 55. The upper ends of the channels 56 and 57 are connected respectively to an ink tank 71 via undepicted tubes or the like. The ink tank 71 is provided with a heater 72 whereby the ink retained in the ink tank 71 is heated to an appropriate temperature for being jetted from the nozzles 45.

Then, the ink retained in the ink tank 71 flows into the common inflow channel 51 of the channel unit 21 through the channels 54 and 56 of the channel member 53. On this occasion, the filter member 50 captures foreign substances and the like in the ink to prevent the same from flowing into the channel unit 21. The ink having flowed into the common inflow channel 51 is supplied to the supply manifolds 46 from the inflow ports 48. Then, in the supply manifolds 46, the ink flows from the upstream side to the downstream side along the conveyance direction to supply the individual channels 28 (the throttle channels 41).

Further, into the feedback manifolds 47, the ink flows from the individual channels 28 (the throttle channels 41) such that the ink flows from the downstream side to the upstream side along the conveyance direction, and the ink flows out of the outflow ports 49. The ink having flowed out of the outflow ports 49 is fed back to the ink tank 71 through the common outflow channel 52 of the channel unit 21 and the channels 55 and 57 of the channel member 53.

In the above manner, according to the first embodiment, the ink circulates between the ink jet head 3 and the ink tank 71. Further, a pump 73 is provided on the way in the channel between the channel 56 and the ink tank 71 such that with that pump being driven, the ink flow occurs so as to circulate between the ink jet head 3 and the ink tank 71. Note that the pump 73 may also be provided on the way in the channel between the channel 57 and the ink tank 71.

Further, for example, when the ink jet head 3 consumes a large amount of the ink such as when the ink is jetted simultaneously from a large number of nozzles 45 during printing, etc., then the ink retained in the ink tank 71 flows into the common outflow channel 52 of the channel unit 21 through the channels 55 and 57 of the channel member 53. On this occasion, the filter member 50 captures foreign substances and the like in the ink to prevent the foreign substances from flowing into the channel unit 21. The ink having flowed into the common outflow channel 52 flows further from the outflow ports 49 into the feedback manifolds 47 to supply the individual channels 28. By virtue of this, in the ink jet head 3, when a large amount of the ink is consumed, the ink is supplied to the individual channels 28 from both the supply manifolds 46 and the feedback manifolds 47 so as to prevent the occurrence of shortage of supplying the ink to the individual channels 28.

Figure 5A:
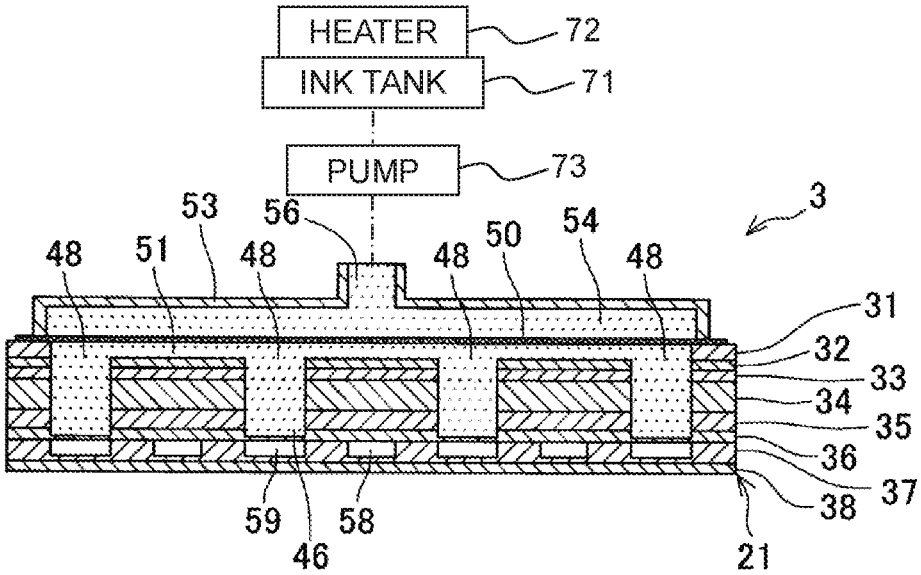
FIG. 5A is a cross-sectional view along the line VA-VA of FIG. 2.

Further, the plate 37 is provided with damper chambers 59 which overlap with the supply manifolds 46 in the up/down direction and separate from the supply manifolds 46. Then, by deforming such partition walls separating the supply manifolds 46 and the damper chambers 59 as formed from a lower end portion of the plate 36, the ink inside the supply manifolds 46 is restrained from pressure variation. Further, the plate 37 is provided with damper chambers 58 which overlap with the feedback manifolds 47 in the up/down direction and separate from the feedback manifolds 47. Then, by deforming such partition walls separating the feedback manifolds 47 and the damper chambers 58 as formed from the lower end portion of the plate 36, pressure variation of the ink inside the feedback manifolds 47 is reduced. Note that the damper chambers 58 and the damper chambers 59 extend in the conveyance direction and, as depicted in FIG. 5A, reach the lower part of the filter member 50. Therefore, it is possible to reduce the pressure variation of the ink inside the supply manifolds 46 and the feedback manifolds 47 more efficiently.

<Piezoelectric Actuator 22>

The piezoelectric actuator 22 has two piezoelectric layers 61 and 62, a common electrode 63, and a plurality of individual electrodes 64. The piezoelectric layers 61 and 62 are made of a piezoelectric material whose primary constituent is lead zirconate titanate (PZT) which is a mixed crystalline of lead zirconate and lead titanate. The piezoelectric layer 61 is arranged on the upper surface of the channel unit 21 while the piezoelectric layer 62 is arranged on the upper surface of the piezoelectric layer 61. Note that the piezoelectric layer 61 may be made of a different material from the piezoelectric layer 62 such as an insulating material other than a piezoelectric material; for example, a synthetic resin material or the like.

The common electrode 63 is arranged between the piezoelectric layer 61 and the piezoelectric layer 62 to extend continuously throughout almost the entire area of the piezoelectric layers 61 and 62. The common electrode 63 is maintained at the ground potential. The plurality of individual electrodes 64 are provided individually for the plurality of pressure chambers 40. Each of the individual electrodes 64 has an approximately rectangular planar shape with the scanning direction as its longitudinal direction, and is arranged to overlap in the up/down direction with a central portion of the corresponding pressure chamber 40. Further, each of the individual electrodes 64 has such an end portion on the far side from the descender channel 42 along the scanning direction as extending to a position not overlapping with the pressure chamber 40. The leading end of each individual electrode 64 is a connecting terminal 64*a* for connection with an undepicted wiring member. The connecting terminals 64*a* of the plurality of individual electrodes 64 are connected to an undepicted driver IC via the undepicted wiring member. Then, the driver IC selectively applies, individually to the plurality of individual electrodes 64, either the ground potential or a predetermined drive potential (for example, 20 V or so). Further, corresponding to such an arrangement of the common electrode 63 and the plurality of individual electrodes 64, such a part of the piezoelectric layer 62 as interposed between each individual electrode 64 and the common electrode 63 forms an active portion polarized in the thickness direction.

Hereinbelow, an explanation will be made about a method for driving the piezoelectric actuator 22 to jet the ink from the nozzles 45. With the piezoelectric actuator 22 in a standby state where the ink is not jetted from the nozzles 45, all the individual electrodes 64 are maintained at the ground potential as with the common electrode 63. For the ink to be jetted from a certain nozzle 45, the ground potential is switched to the drive potential in the two individual electrodes 64 corresponding to the two pressure chambers 40 connected to that nozzle 45.

Then, in the two active portions corresponding to the above two individual electrodes 64, such an electric field is generated as parallel to the polarization direction such that the above two active portions contract in a horizontal direction orthogonal to the polarization direction. By virtue of this, such parts of the piezoelectric layers 61 and 62 as overlapping in the up/down direction with the above two pressure chambers 40 are deformed as a whole to project toward the pressure chambers 40. As a result, the volumes of the pressure chambers 40 decrease such that the pressure on the ink in the pressure chambers 40 increases, so as to cause the ink to be jetted from the nozzle 45 in communication with the pressure chambers 40. Further, after the ink is jetted from the nozzle 45, the potential of the above two individual electrodes 64 is returned to the ground potential. With this, the piezoelectric layers 61 and 62 return to the state before being deformed.

In the first embodiment explained above, the supply manifolds 46 and the feedback manifolds 47 align alternately in the scanning direction. Therefore, in the scanning direction, an outflow port 49 is arranged between two adjacent inflow ports 48 whereas an inflow ports 48 is arranged between two adjacent outflow ports 49.

Further, in the first embodiment, the inflow ports 48 and the outflow ports 49 are arranged to deviate from each other in the conveyance direction. By virtue of this, because no outflow port 49 is arranged in the area adjacent to the inflow ports 48 along the scanning direction, it is possible to connect the inflow ports 48 with each other with the common inflow channel 51 of a simple structure extending in the scanning direction. Further, because no inflow port 48 is arranged in the area adjacent to the outflow ports 49 along the scanning direction, it is possible to connect the outflow ports 49 with each other with the common outflow channel 52 of a simple structure extending in the scanning direction. Then, because those channels have such simple structures, it is possible to suppress pressure loss in the ink when the ink is supplied to the ink jet head 3.

Further, in the first embodiment, the ink is first heated by the heater 72 in the ink tank 71 and then supplied to the ink jet head 3. On this occasion, because the ink decreases in temperature when the ink is flowing through the channels in the ink jet head 3, the ink flowing in the supply manifolds 46 has a higher temperature than the ink flowing in the feedback manifolds 47. On the other hand, the ink jet head 3 is cooled more, usually, in the outer part, due to the ambient air.

Here, in the first embodiment, among the supply manifolds 46 and feedback manifolds 47 aligning alternately in the scanning direction, the manifolds positioned at the two opposite ends along the scanning direction act as the supply manifolds 46. By virtue of this, it is possible for the high temperature ink flowing through the supply manifolds 46 to restrain end portions of the ink jet head 3 along the scanning direction from being cooled due to the ambient air.

Further, in the first embodiment, in the conveyance direction, the inflow ports 48 are positioned on the upstream side along the conveyance direction from the outflow ports 49. By virtue of this, it is possible for the high temperature ink flowing through the supply manifolds 46 to restrain upstream end portions of the ink jet head 3 along the conveyance direction from being cooled due to the ambient air.

Further, in the first embodiment, in the supply manifolds 46 and the feedback manifolds 47, the parts including the connected parts connected to the plurality of individual channels 28 are the same in the length along the scanning direction (W11=W13). Therefore, in the supply manifolds 46 and the feedback manifolds 47, the parts including the connected parts connected to the plurality of individual channels 28 are the same in the area of the cross section orthogonal to the conveyance direction. By virtue of this, in the four supply manifolds 46 and the three feedback manifolds 47, it is possible to equalize the channel resistance. Further, the ratio between the sum of the above sectional areas of the four supply manifolds 46 and the sum of the above sectional areas of the three feedback manifolds 47 is 4:3, which is the same as the ratio between the number (four) of the supply manifolds 46 and the number (three) of the feedback manifolds 47.

Further, because the inflow ports 48 are positioned on the upstream side along the conveyance direction from the outflow ports 49, the supply manifolds 46 have a larger length than the feedback manifolds 47 along the conveyance direction in the parts positioned on the upstream side from the connected parts with the individual channels 28 at the upmost stream side along the conveyance direction. With respect to this, in the first embodiment, the supply manifolds 46 have a larger area of the cross section orthogonal to the conveyance direction than the feedback manifolds 47 in the above parts. By virtue of this, between the four supply manifolds 46 and the three feedback manifolds 47, it is possible to equalize the channel resistance of the above parts.

Further, in the first embodiment, the common inflow channel 51 connected to the inflow ports 48 has a larger area of the cross section orthogonal to the up/down direction than the common outflow channel 52 connected to the outflow ports 49. By virtue of this, the channel resistance of the common inflow channel 51 becomes smaller than the channel resistance of the common outflow channel 52, such that between the channels formed from the supply manifolds 46 and the common inflow channel 51 and the channels formed from the feedback manifolds 47 and the common outflow channel 52, it is possible to equalize the channel resistance.

Further, in order to let the common inflow channel 51 have a larger area of the cross section orthogonal to the up/down direction than the common outflow channel 52, it is conceivable that the common inflow channel 51 may have the same length along the conveyance direction as the common outflow channel 52 and have a larger length along the scanning direction than the common outflow channel 52. Alternatively, it is also conceivable to let the common inflow channel 51 have both a larger length along the conveyance direction and a larger length along the scanning direction than the common outflow channel 52. However, in those cases, the common inflow channel 51 becomes wider than the common outflow channel 52 along the scanning direction, such that the ink jet head 3 is liable to grow in size along the scanning direction wherein the manifolds 46 and 47 align.

In the first embodiment, the common inflow channel 51 has the same length along the scanning direction as the common outflow channel 52 (W14=W15). Further, the common inflow channel 51 has a larger length along the conveyance direction than the common outflow channel 52 (L11>L12). Therefore, the common inflow channel 51 has a larger area of the cross section orthogonal to the up/down direction than the common outflow channel 52. By virtue of this, while the common inflow channel 51 has the larger sectional area described above than the common outflow channel 52, it is still possible to place the common inflow channel 51 within the range of arranging the common outflow channel 52.

Further, in the first embodiment, the common inflow channel 51 and the common outflow channel 52 are open in the upper surface of the channel unit 21 (on the same plane). Therefore, as described earlier on, it is possible for the one filter member 50 extending across the common inflow channel 51 and the common outflow channel 52 to form the first filter preventing foreign substances from flowing into the common inflow channel 51 and the supply manifolds 46, and the second filter preventing foreign substances from flowing into the common outflow channel 52 and the feedback manifolds 47, so as to simplify the structure of the ink jet head 3. Further, by forming the one filter member 50, it is possible to sufficiently secure the area of the filter member 50. That is, it is possible to widely secure the area to allow for capturing foreign substances and the like in the ink and, as a result, it is possible to use the filter member 50 over a long period of time.

Second Embodiment

Next, a second preferred embodiment of the present teaching will be explained. The second embodiment is different from the first embodiment in arrangement and the like of the supply manifold channels and the feedback manifold channels in the ink jet head.

As depicted in FIGS. 6 to 8B, an ink jet head 100 according to the second embodiment includes a channel unit 101 and a piezoelectric actuator 102.

<Channel Unit 101>

The channel unit 101 is formed by stacking eight plates 111 to 118 from above in the order of the plate numbers. The channel unit 101 is formed therein with a plurality of pressure chambers 120, a plurality of throttle channels 121, a plurality of descender channels 122 (the "connecting channel" of the present teaching), a plurality of circulation channels 123, a plurality of nozzles 125, six supply manifolds 126 (the "first manifold" of the present teaching), and six feedback manifolds 127 (the "second manifold" of the present teaching).

The plurality of pressure chambers 120 are formed in the plate 111. The pressure chambers 120 have the same shape as the pressure chambers 40 (see FIG. 2). Further, the plurality of pressure chambers 120 are arrayed in the conveyance direction to form pressure chamber rows 119. Further, six of the pressure chamber rows 119 are aligned in the scanning direction in the plate 111. Further, between the pressure chamber rows 119, the pressure chambers 120 deviate in position along the conveyance direction.

The plurality of throttle channels 121 are formed across the plates 112 and 113. The throttle channels 121 have the same shape as the throttle channels 41 (see FIG. 2), and each of the pressure chambers 120 is provided individually with a throttle channel 121. The throttle channels 121 are connected to the left ends of the pressure chambers 120 and extend leftward from the connected parts with the pressure chambers 120.

The plurality of descender channels 122 are formed of overlapping through holes formed in the plates 112 to 117 in the up/down direction. Each of the pressure chambers 120 is provided individually with a descender channel 122. The descender channels 122 are connected to the right ends of the pressure chambers 120 and extend downward from the connected parts with the pressure chambers 120.

The plurality of circulation channels 123 are formed in a lower portion of the plate 117. Each of the circulation channels 123 is provided individually with a descender channel 122. The descender channels 122 are connected to the left lower ends of the lateral walls of the descender channels 122 and extend leftward from the connected parts with the descender channels 122. The plurality of nozzles 125 are formed in the plate 118. Each of the nozzles 125 is provided individually with a descender channel 122 and connected to the lower end of the descender channel 122.

Then, among the ink channels explained above, individual channels 108 are formed from the nozzles 125, the descender channels 122 connected to the nozzles 125, the circulation channels 123 and pressure chambers 120 connected to the descender channels 122, and the throttle channels 121 connected to the pressure chambers 120. Further, the plurality of individual channels 108 are arrayed in the conveyance direction to form individual channel rows 107. Further, in the channel unit 101, six rows of the individual channel rows 107 are formed to align along the scanning direction.

Six supply manifolds 126 are formed in the plate 114. The six supply manifolds 126 extend respectively in the conveyance direction to align in the scanning direction at intervals. The six supply manifolds 126 correspond to the six individual channel rows 107, and the respective supply manifolds 126 are connected to the throttle channels 121 of the plurality of individual channels 108 forming the corresponding individual channel rows 107. Further, the supply manifolds 126 have a constant length W21 along the scanning direction, independent from the position along the conveyance direction.

Further, each of the supply manifolds 126 extends in the up/down direction across the plates 112 to 114 at the upstream end along the conveyance direction and is provided with an inflow port 128 (the "first connecting port" of the present teaching) in its upper end portion. Further, in correspondence with that, the plate 111 is formed with a common inflow channel 131 (the "common channel" or the "first common channel" of the present teaching) extending in the scanning direction across the inflow ports 128 of the six supply manifolds 126 to connect the inflow ports 128 with each other.

The six feedback manifolds 127 are formed in plate 117. The six feedback manifolds 127 extend respectively in the conveyance direction to align in the scanning direction at intervals and overlap with the supply manifolds 126 in the up/down direction. By virtue of this, the supply manifolds 126 are positioned above the feedback manifolds 127. Further, the feedback manifolds 127 extend to the upstream side along the conveyance direction from the supply manifolds 126.

Further, the feedback manifolds 127 have a large length along the scanning direction in the parts positioned on the upstream side from the connected parts with the individual channels 108 at the upmost stream side along the conveyance direction. In particular, the feedback manifolds 127 have a length W23 (>W22) along the scanning direction in the upstream parts along the conveyance direction from such parts having the length W22 along the scanning direction as including the connected parts with the plurality of individual channels 108. Since the length W22 is the same as the length W21, the length W23 is larger than the length W21. By virtue of this, the feedback manifolds 127 have a larger area of the cross section orthogonal to the conveyance direction than the supply manifolds 126 in the parts positioned on the upstream side from the connected parts with the individual channels 108 on the upmost stream side along the conveyance direction.

Further, each of the feedback manifolds 127 extends in the up/down direction across the plates 112 to 117 at the upstream end along the conveyance direction and is provided with an outflow port 129 (the "second connecting port" of the present teaching) in its upper end portion. Further, in correspondence with that, the plate 111 is formed with a common outflow channel 132 (the "second common channel" of the present teaching) extending in the scanning direction across the outflow ports 129 of the six feedback manifolds 127 to connect the outflow ports 129 with each other.

Here, as described earlier on, the feedback manifolds 127 extend farther to the upstream side along the conveyance direction than the supply manifolds 126. By virtue of this, the outflow ports 129 are positioned on the upstream side from the inflow ports 128 along the conveyance direction. That is, the inflow ports 128 and the outflow ports 129 are arranged to deviate from each other along the conveyance direction.

Further, the length W24 of the common inflow channel 131 along the scanning direction is the same as the length W25 of the common outflow channel 132 along the conveyance direction. On the other hand, the length L22 of the common outflow channel 132 along the conveyance direction is larger than the length L21 of the common inflow channel 131 along the conveyance direction. By virtue of this, the common outflow channel 132 has a larger area of the cross section orthogonal to the up/down direction than the common inflow channel 131.

Further, on the upper surface of the channel unit 101, a filter member 130 is arranged to extend across the common inflow channel 131 and the common outflow channel 132. Further, in the second embodiment, such a part of the filter member 130 as overlapping with the common inflow channel 131 corresponds to the "first filter" of the present teaching, while the part overlapping with the common outflow channel 132 corresponds to the "second filter" of the present teaching. Further, on the upper surface of the channel unit 101 where the filter member 130 is arranged, a channel member 133 is arranged in the part overlapping with the common inflow channel 131 and the common outflow channel 132.

The channel member 133 is formed with channels 134 to 137. The channels 134 and 135 extend respectively in the scanning direction through the entire length of the common inflow channel 131 and common outflow channel 132. The channels 136 and 137 are connected respectively to central portions of the channels 134 and 135 along the scanning direction to extend upward from the connected parts with the channels 134 and 135. The upper ends of the channels 136 and 137 are connected respectively to an ink tank 140 via undepicted tubes or the like.

Then, the ink retained in the ink tank 140 flows into the common inflow channel 131 of the channel unit 101 through the channels 134 and 136 of the channel member 133. On this occasion, the filter member 130 captures foreign substances and the like in the ink to prevent the same from flowing into the channel unit 101. The ink having flowed into the common inflow channel 131 is supplied to the supply manifolds 126 from the inflow ports 128. Then, in the supply manifolds 126, the ink flows from the upstream side to the downstream side along the conveyance direction to supply the individual channels 108 (the throttle channels 121).

Further, into the feedback manifolds 127, the ink flows from the individual channels 108 (the circulation channels 123) such that the ink flows from the downstream side to the upstream side along the conveyance direction, and the ink flows out of the outflow ports 129. The ink having flowed out of the outflow ports 129 is fed back to the ink tank 140 through the common outflow channel 132 of the channel unit 101 and the channels 135 and 137 of the channel member 133.

In the above manner, according to the second embodiment, the ink circulates between the ink jet head 100 and the ink tank 140. Further, a pump 145 is provided on the way in the channel between the channel 136 and the ink tank 140 such that with that pump being driven, the ink flow occurs so as to circulate between the ink jet head 100 and the ink tank 140. Note that the pump 145 may also be provided on the way in the channel between the channel 137 and the ink tank 140.

Further, for example, when the ink jet head 100 consumes a large amount of the ink such as when the ink is jetted simultaneously from a large number of nozzles 125 during printing, etc., then the ink retained in the ink tank 140 flows into the common outflow channel 132 of the channel unit 101 through the channels 135 and 137 of the channel member 133. On this occasion, the filter member 130 captures foreign substances and the like in the ink to prevent the foreign substances from flowing into the channel unit 101. The ink having flowed into the common outflow channel 132 flows further from the outflow ports 129 into the feedback manifolds 127 to supply the individual channels 108. By virtue of this, in the ink jet head 100, when a large amount of the ink is consumed, the ink is supplied to the individual channels 108 from both the supply manifolds 126 and the feedback manifolds 127 so as to prevent the occurrence of shortage of supplying the ink.

Further, the channel unit 101 is provided with damper chambers 139 which extend across a lower part of the plate 115 and an upper part of the plate 116 and overlap with the supply manifolds 126 and the feedback manifolds 127 in the up/down direction. Then, by deforming such partition walls separating the supply manifolds 126 and the damper chambers 139 as formed from an upper end portion of the plate 115, the ink inside the supply manifolds 126 is restrained from pressure variation. Further, by deforming such partition walls separating the feedback manifolds 127 and the damper chambers 139 as formed from a lower end portion of the plate 116, the ink inside the feedback manifolds 127 is restrained from pressure variation.

<Piezoelectric Actuator 102>

The piezoelectric actuator 102 has two piezoelectric layers 141 and 142, a common electrode 143, and a plurality of individual electrodes 144. The piezoelectric layers 141 and 142 are made of a piezoelectric material. The piezoelectric layer 141 is arranged on the upper surface of the channel unit 101 while the piezoelectric layer 142 is arranged on the upper surface of the piezoelectric layer 141. Note that as with the piezoelectric layer 61 (see FIG. 4), the piezoelectric layer 141 may be made of an insulating material other than a piezoelectric material.

The common electrode 143 is arranged between the piezoelectric layer 141 and the piezoelectric layer 142 to extend continuously throughout almost the entire area of the piezoelectric layers 141 and 142. The common electrode 143 is maintained at the ground potential. The plurality of individual electrodes 144 are provided individually for the plurality of pressure chambers 120. Each of the individual electrodes 144 has the same shape as the individual electrodes 64 (see FIG. 2), and is arranged to overlap in the up/down direction with a central portion of the corresponding pressure chamber 120. Further, each of the plurality of individual electrodes 144 has a connecting terminal **144*a* which is connected to an undepicted driver IC via an undepicted wiring member. Then, the driver IC selectively applies, individually to the plurality of individual electrodes 144, either the ground potential or the drive potential. Further, corresponding to such an arrangement of the common electrode 143 and the plurality of individual electrodes 144, such a part of the piezoelectric layer 142 as interposed between each individual electrode 144 and the common electrode 143** forms an active portion polarized in the thickness direction.

Hereinbelow, an explanation will be made about a method for driving the piezoelectric actuator 102 to jet the ink from the nozzles 125. With the piezoelectric actuator 102 in a standby state where the ink is not jetted from the nozzles 125, all the individual electrodes 144 are maintained at the ground potential as with the common electrode 143. For the ink to be jetted from a certain nozzle 125, the ground potential is switched to the drive potential in the individual electrodes 144 corresponding to that nozzle 125.

Then, in the same manner as in the first embodiment, such parts of the piezoelectric layers 141 and 142 as overlapping in the up/down direction with the pressure chambers 120 are deformed as a whole to project toward the pressure chambers 120. As a result, the volumes of the pressure chambers 120 decrease such that the pressure on the ink in the pressure chambers 120 increases, so as to cause the ink to be jetted from the nozzles 125 in communication with the pressure chambers 120. Further, after the ink is jetted from the nozzles 125, the potential of the individual electrodes 144 is returned to the ground potential.

In the second embodiment explained above, the supply manifolds 126 and the feedback manifolds 127 align in the up/down direction. Therefore, deferring from the first embodiment, it is necessary to have positional deviation along the scanning direction of the ends on the upstream side along the conveyance direction between the supply manifolds 126 and the feedback manifolds 127, if the positions of the inflow ports 128 along the conveyance direction are to be set the same as the positions of the outflow ports 129 along the conveyance direction. For example, it is necessary to flex or bend at least either the supply manifolds 126 or the feedback manifolds 127, etc., in the scanning direction in such parts as in the vicinity of the ends on the upstream side along the conveyance direction. In such cases, by bending at least either the supply manifolds 126 or the feedback manifolds 127, etc., the channels become a complicated structure.

Further, in such cases, one outflow port 129 is arranged between two adjacent inflow ports 128 along the scanning direction. Further, one inflow port 128 is arranged between two adjacent outflow ports 129 along the scanning direction. Therefore, in order to form channels connecting the inflow ports 128 with each other, it is necessary to form the channels kept off the outflow ports 129 positioned therebetween. Further, in order to form channels connecting the outflow ports 129 with each other, it is necessary to form the channels kept off the inflow ports 128 positioned therebetween. As a result, the channels in the ink jet head 100 become a complicated structure.

Then, if the channels have a complicated structure, then the pressure loss in the ink becomes large when the ink is supplied to the ink jet head 100.

In the second embodiment, however, the inflow ports 128 and the outflow ports 129 are arranged to deviate along the conveyance direction. By virtue of this, it is not necessary to bend the manifolds 126 and 127 in the vicinity of the upstream parts. Further, separation along the conveyance direction is made between the area where the inflow ports 128 of the six supply manifolds 126 are arranged and the area where the outflow ports 129 of the six feedback manifolds 127 are arranged. By virtue of this, it is possible to connect the inflow ports 128 with each other through the common inflow channel 131 of a simple structure extending in the scanning direction. Further, it is possible to connect the outflow ports 129 with each other through the common outflow channel 132 of a simple structure extending in the scanning direction. Due to those aspects, it is possible to simplify the structure of the channels in the ink jet head 100, and thereby it is possible to suppress the pressure loss in the ink when the inks is supplied to the ink jet head 100.

Further, in the second embodiment, the inflow ports 128 and the outflow ports 129 are open at the upper side, and the supply manifolds 126 are positioned above the feedback manifolds 127. On the other hand, the outflow ports 129 are positioned at the upstream side from the inflow ports 128 along the conveyance direction. By virtue of this, the upstream ends of the supply manifolds 126 and the feedback manifolds 127 along the conveyance direction become a simple structure extending in the up/down direction, respectively.

Further, in the second embodiment, because the outflow ports 129 are positioned on the upstream side along the conveyance direction from the inflow ports 128, the feedback manifolds 127 have a larger length than the supply manifolds 126 along the conveyance direction in the parts positioned on the upstream side from the connected parts with the individual channels 108 at the upmost stream side along the conveyance direction. With respect to this, in the second embodiment, the feedback manifolds 127 have a larger area of the cross section orthogonal to the conveyance direction than the supply manifolds 126 in the above parts. By virtue of this, between the supply manifolds 126 and the feedback manifolds 127, it is possible to equalize the channel resistance of the above parts.

Further, in the second embodiment, the common outflow channel 132 connected to the outflow ports 129 has a larger area of the cross section orthogonal to the up/down direction than the common inflow channel 131 connected to the inflow ports 128. By virtue of this, the channel resistance of the common outflow channel 132 becomes smaller than the channel resistance of the common inflow channel 131, such that between the channels formed from the supply manifolds 126 and the common inflow channel 131 and the channels formed from the feedback manifolds 127 and the common outflow channel 132, it is possible to equalize the channel resistance.

Further, in order to let the common outflow channel 132 have a larger area of the cross section orthogonal to the up/down direction than the common inflow channel 131, it is conceivable that the common outflow channel 132 may have the same length along the conveyance direction as the common inflow channel 131 and have a larger length along the scanning direction than the common inflow channel 131. Alternatively, it is also conceivable to let the common outflow channel 132 have both a larger length along the conveyance direction and a larger length along the scanning direction than the common inflow channel 131. However, in those cases, the common outflow channel 132 becomes wider than the common inflow channel 131 along the scanning direction, such that the ink jet head 100 is liable to grow in size along the scanning direction wherein the manifolds 126 and 127 align.

In the second embodiment, the common outflow channel 132 has the same length along the scanning direction as the common inflow channel 131 (W24=W25) and a larger length along the conveyance direction than the common inflow channel 131 (L22>L21). Therefore, the common outflow channel 132 has a larger area of the cross section orthogonal to the up/down direction than the common inflow channel 131. By virtue of this, while the common outflow channel 132 has the larger sectional area described above than the common inflow channel 131, it is still possible to place the common outflow channel 132 within the range of arranging the common inflow channel 131.

Further, in the second embodiment, the common inflow channel 131 and the common outflow channel 132 are open in the upper surface of the channel unit 101 (on the same plane). Therefore, as described earlier on, it is possible for the one filter member 130 extending across the common inflow channel 131 and the common outflow channel 132 to form the first filter preventing foreign substances from flowing into the common inflow channel 131 (the supply manifold 126), and the second filter preventing foreign substances from flowing into the common outflow channel 132 (the feedback manifolds 127), so as to simplify the structure of the ink jet head 100. Further, by forming the one filter member 130, it is possible to sufficiently secure the area of the filter member 130. That is, it is possible to widely secure the area to allow for capturing foreign substances and the like in the ink and, as a result, it is possible to use the filter member 130 over a long period of time.

Hereinabove, the preferred embodiments of the present teaching were explained. However, the present teaching is not limited to the above explanation but it is possible to apply various changes and modifications thereto without departing from the scope set forth in the appended claims.

For example, in the first embodiment, different or divergent members may be used as the first filter preventing foreign substances and the like from flowing into the common inflow channel 51 and the second filter preventing foreign substances and the like from flowing into the common outflow channel 52. Likewise, in the second embodiment, different or divergent members may be used as the first filter preventing foreign substances and the like from flowing into the common inflow channel 131 and the second filter preventing foreign substances and the like from flowing into the common outflow channel 132. Alternatively, if the filters are provided in the channels on the upstream side from the ink jet head 3 or 100, then the first and second filters may not be provided in the ink jet head 3 or 100.

Further, in the first embodiment, in order to let the common inflow channel 51 have a larger area of the cross section orthogonal to the up/down direction than the common outflow channel 52, the common inflow channel 51 may be configured the same in the length along the conveyance direction as the common outflow channel 52 but larger in the length along the scanning direction than the common outflow channel 52. Alternatively, the common inflow channel 51 may be larger than the common outflow channel 52 in the lengths both along the scanning direction and along the conveyance direction.

likewise, in the second embodiment, the common outflow channel 132 may be the same in the length along the conveyance direction as the common inflow channel 131 but larger in the length along the scanning direction than the common inflow channel 131. Alternatively, the common outflow channel 132 may be larger than the common inflow channel 131 in the lengths both along the scanning direction and along the conveyance direction.

Further, in the first embodiment, the area of the cross section of the common inflow channel 51 orthogonal to the up/down direction may be not larger than the area of the cross section of the common outflow channel 52 orthogonal to the up/down direction. Likewise, in the second embodiment, the area of the cross section of the common inflow channel 131 orthogonal to the up/down direction may be not smaller than the area of the cross section of the common outflow channel 132 orthogonal to the up/down direction.

Further, in the first embodiment, the supply manifolds 46 may have the same or a smaller area of the cross section orthogonal to the conveyance direction as or than the feedback manifolds 47 in the parts positioned on the upstream side from the connected parts with the individual channels 28 on the upmost stream side along the conveyance direction. Likewise, in the second embodiment, the feedback manifolds 127 may have the same or a smaller area of the cross section orthogonal to the conveyance direction as or than the supply manifolds 126 in the parts positioned on the upstream side from the connected parts with the individual channels 28 on the upmost stream side along the conveyance direction.

Further, in the first embodiment, all of the four supply manifolds 46 and the three feedback manifolds 47 have the same area of the cross sections orthogonal to the conveyance direction. Without being limited to that, at least among the supply manifolds 46, among the feedback manifolds 47, or among the supply manifolds 46 and the feedback manifolds 47, the above sectional area may differ. Further, on such occasions, the number of supply manifolds 46 may either be three or less or be five or more, while the number of feedback manifolds 47 may either be two or less or be four or more.

In those cases, if the ratio between the sum of the above sectional areas of the supply manifolds 46 and the sum of the above sectional areas of the feedback manifolds 47 is set as the ratio between the number of the supply manifolds 46 and the number of the feedback manifolds 47, it is possible to equalize the channel resistance between the supply manifolds 46 and the feedback manifolds 47. Alternatively, the ratio between the sum of the above sectional areas of the supply manifolds 46 and the sum of the above sectional areas of the feedback manifolds 47 may differ from the ratio between the number of the supply manifolds 46 and the number of the feedback manifolds 47.

Further, in the first embodiment, the outflow ports 49 may be positioned on the upstream side from the inflow ports 48 along the conveyance direction.

Further, in the first embodiment, the channel unit 21 is formed with the common inflow channel 51 extending in the scanning direction to render communication between the inflow ports 48 with each other, and the common outflow channel 52 extending in the scanning direction to render communication between the outflow ports 49 with each other. However, the present teaching is not limited to that.

Figure 9A:
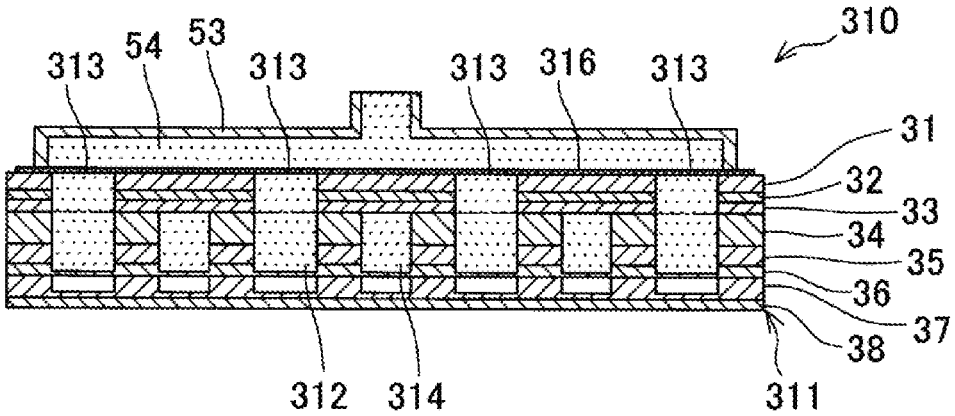
FIG. 9A is a cross-sectional view, along a scanning direction, of such a part of an ink jet head according to a first modified embodiment as positioned an upstream end portion of a supply manifold along a conveyance direction.
Figure 9B:
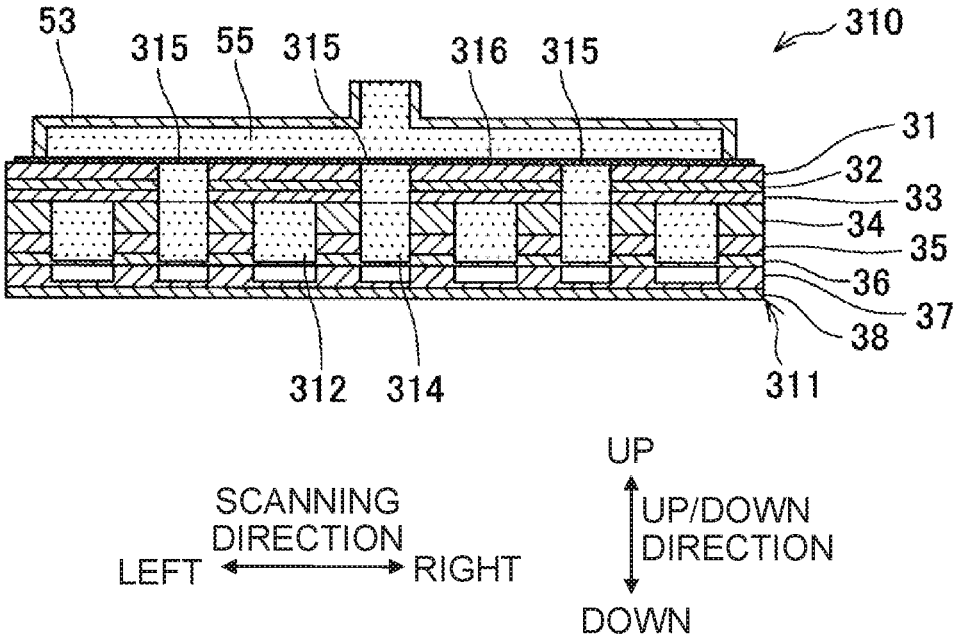
FIG. 9B is a cross-sectional view, along the scanning direction, of such a part of the ink jet head according to the first modified embodiment as positioned an upstream end portion of a feedback manifold along the conveyance direction.

According to a first modified embodiment, as depicted in FIG. 9A, in an ink jet head 310, an upstream portion of a supply manifold 312 along the conveyance direction extends in the up/down direction across the plates 31 to 36, and inflow ports 313 are provided in its upper end portion. Further, as depicted in FIG. 9B, an upstream portion of a feedback manifold 314 along the conveyance direction extends in the up/down direction across the plates 31 to 36, and inflow ports 315 are provided in its upper end portion. That is, in the first modified embodiment, the inflow ports 313 and the outflow ports 315 are positioned in the upper surface of the channel unit 311 (on the same plane).

Then, on the upper surface of the channel unit 311, a filter member 316 is arranged to extend across the four inflow ports 313 and the three outflow ports 315. Further, in the same manner as in in the first embodiment, on the upper surface of the channel unit 311 where the filter member 316 is arranged, the channel member 53 is arranged. The inflow ports 313 are connected to each other through the channel 54 (the "common channel", the "first common channel", or the "common inflow channel" of the present teaching) of the channel member 53 extending in the scanning direction.

In this case, too, the four inflow ports 313 and the three outflow ports 315 are arranged on the upper surface of the channel unit 311. Therefore, as described earlier on, it is possible for the one filter member 316 extending across the four inflow ports 313 and the three outflow ports 315 to form the first filter preventing foreign substances from flowing into the supply manifold 312 from the inflow ports 313, and the second filter preventing foreign substances from flowing into the feedback manifold 314 from the outflow ports 315, so as to simplify the structure of the ink jet head 310.

In the first modified embodiment, on the upper surface of the channel unit 311, the filter member extending across the four inflow ports 313 may be arranged separately from the filter member extending across three outflow ports 315. Alternatively, on the upper surface of the channel unit 311, a plurality of filter members may be arranged to respectively cover at least one of the four inflow ports 313 and one of the three outflow ports 315.

Further, in the second embodiment, too, in the same manner as described above, without forming the common inflow channel 131 and the common outflow channel 132 (see FIG. 6) in the channel unit, the inflow ports and outflow ports may be formed in the upper surface of the channel unit.

Further, in the first embodiment, among the supply manifolds 46 and the feedback manifolds 47 aligned alternately in the scanning direction, the two manifolds positioned at the two opposite ends in the scanning direction are supply manifolds 46. Without being limited to that, the number of feedback manifolds may be one more than the number of supply manifolds and, among those manifolds alternately aligned in the scanning direction, those positioned at the two opposite ends may be feedback manifolds. In the first embodiment, for example, the channels used as the supply manifolds 46 may be used as the feedback manifolds (the "second manifold" of the present teaching), whereas the channels used as the feedback manifolds 47 may be used as the supply manifolds (the "first manifold" of the present teaching).

Alternatively, for example, the number of supply manifolds may be the same as the number of feedback manifolds and, among those alternately aligned manifolds, the manifold positioned at one end along the scanning direction may be a supply manifold whereas the manifold positioned at the other end along the scanning direction may be a feedback manifold.

Further, in the first embodiment, the supply manifolds 46 and the feedback manifolds 47 are aligned alternately along the scanning direction. However, without being limited to that, the supply manifolds and the feedback manifolds may be arranged in such a positional relation different from the first embodiment that two or more feedback manifolds are positioned between two adjacent supply manifolds. Alternatively, the supply manifolds and the feedback manifolds may be arranged in such a positional relation different from the first embodiment that two or more supply manifolds are positioned between two adjacent feedback manifolds.

Further, in the above case, the ink jet head may not be formed therein with both a plurality of supply manifolds and a plurality of feedback manifolds being. In the case where a feedback manifold or feedback manifolds is/are formed between two adjacent supply manifolds, the ink jet head may be formed with only one feedback manifold. Further, in the case where a supply manifold or supply manifolds is/are formed between two adjacent feedback manifolds, the ink jet head may be formed with only one supply manifold.

Further, in the case where the supply manifolds and the feedback manifolds align in the scanning direction, a feedback manifold(s) may not be arranged between two adjacent supply manifolds, and/or a supply manifold(s) may not be arranged between two adjacent feedback manifolds. For example, a plurality of supply manifolds may align in the scanning direction while the feedback manifold(s) may be arranged either on the right or on the left of those supply manifolds. In such a case, too, by arranging the inflow ports and the outflow ports to deviate along the conveyance direction, no outflow ports are present in the area adjacent to the inflow ports along the scanning direction such that there is a high degree of freedom for arranging the common channel connected to the inflow ports. Likewise, a plurality of feedback manifolds may align in the scanning direction while the supply manifold(s) may be arranged either on the right or on the left of those feedback manifolds.

Further, in the second embodiment, the supply manifolds 126 are positioned above the feedback manifolds 127 and, in the respective individual channels 108, the ink flows into the throttle channels 121 from the supply manifolds 126 and flows out from the circulation channels 123 to the feedback manifolds 127. However, without being limited to that, the channels used as the feedback manifolds 127 in the second embodiment may be used as the supply manifolds while the channels used as the supply manifolds 126 in the second embodiment may be used as the feedback manifolds. In such a case, in the respective individual channels 108, the ink flows into the circulation channels 123 from the supply manifolds and flows out to the feedback manifolds from the throttle channels 121.

Further, in the above examples, the inflow ports and the outflow ports are provided only in the upstream end portions of the manifolds along the conveyance direction. However, the present teaching is not limited to that.

Figure 10:
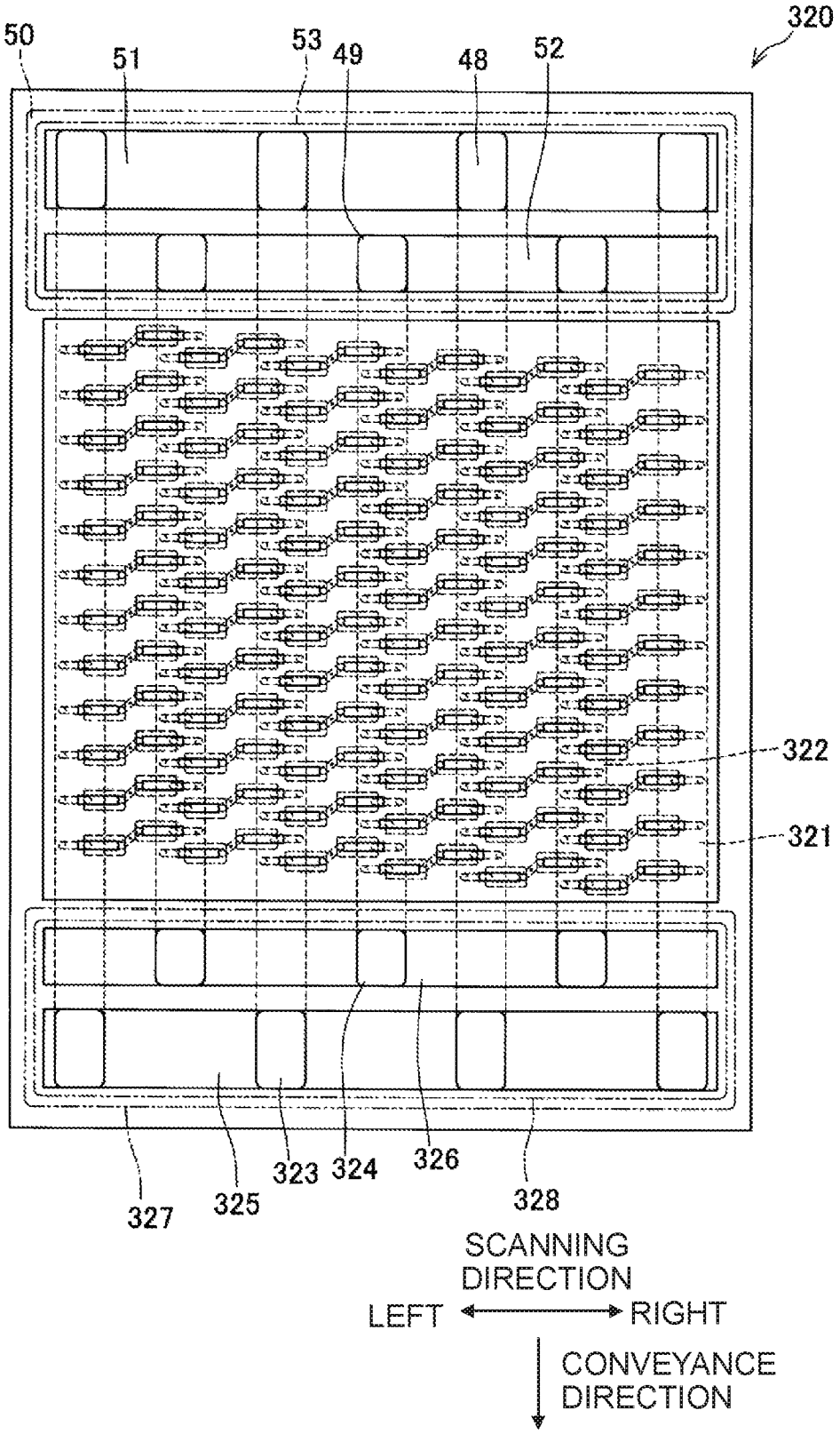
FIG. 10 is a plan view of an ink jet head according to a second modified embodiment.

As depicted in FIG. 10, in an ink jet head 320 according to a second modified embodiment, supply manifolds 321 and feedback manifolds 322 extend in the conveyance direction to the downstream side as compared to the supply manifolds 46 and the feedback manifolds 47 of the ink jet head 3 in the first embodiment (see FIG. 2). Further, the supply manifolds 321 extend in the conveyance direction to the downstream side from the feedback manifolds 322.

Then, inflow ports 323 (the "third connecting port" of the present teaching) and outflow ports 324 (the "fourth connecting port" of the present teaching) are provided respectively in downstream end portions of the supply manifolds 321 and the feedback manifolds 322 along the conveyance direction. The inflow ports 323 are positioned on the downstream side from the outflow ports 324 along the conveyance direction. That is, the inflow ports 323 and the outflow ports 324 are arranged to deviate along the conveyance direction.

Figure 5B:
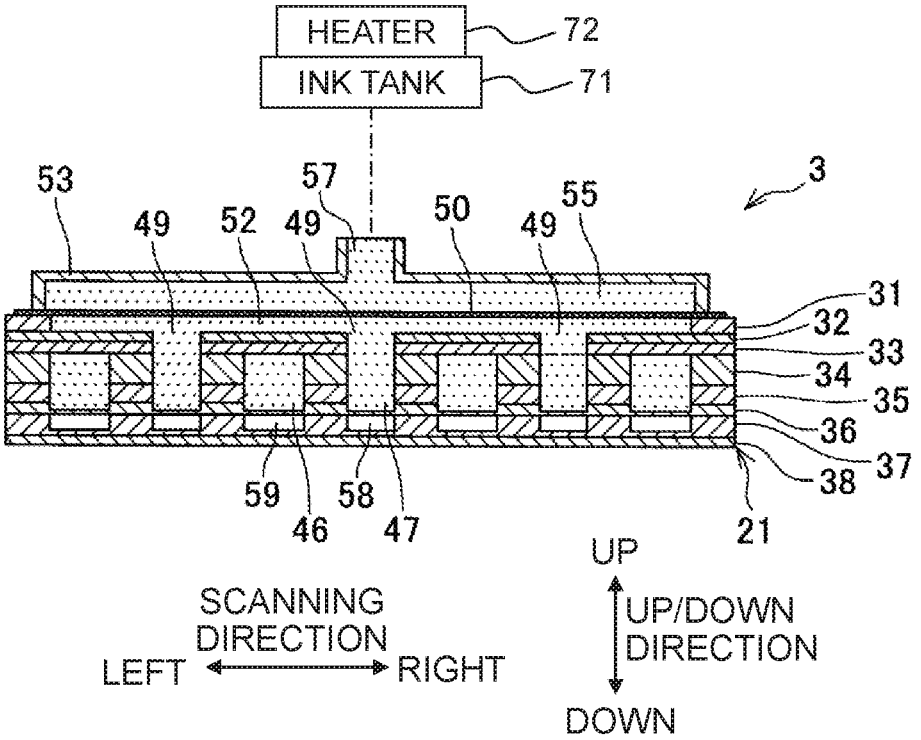
FIG. 5B is a cross-sectional view along the line VB-VB of FIG. 2.
Figure 6:
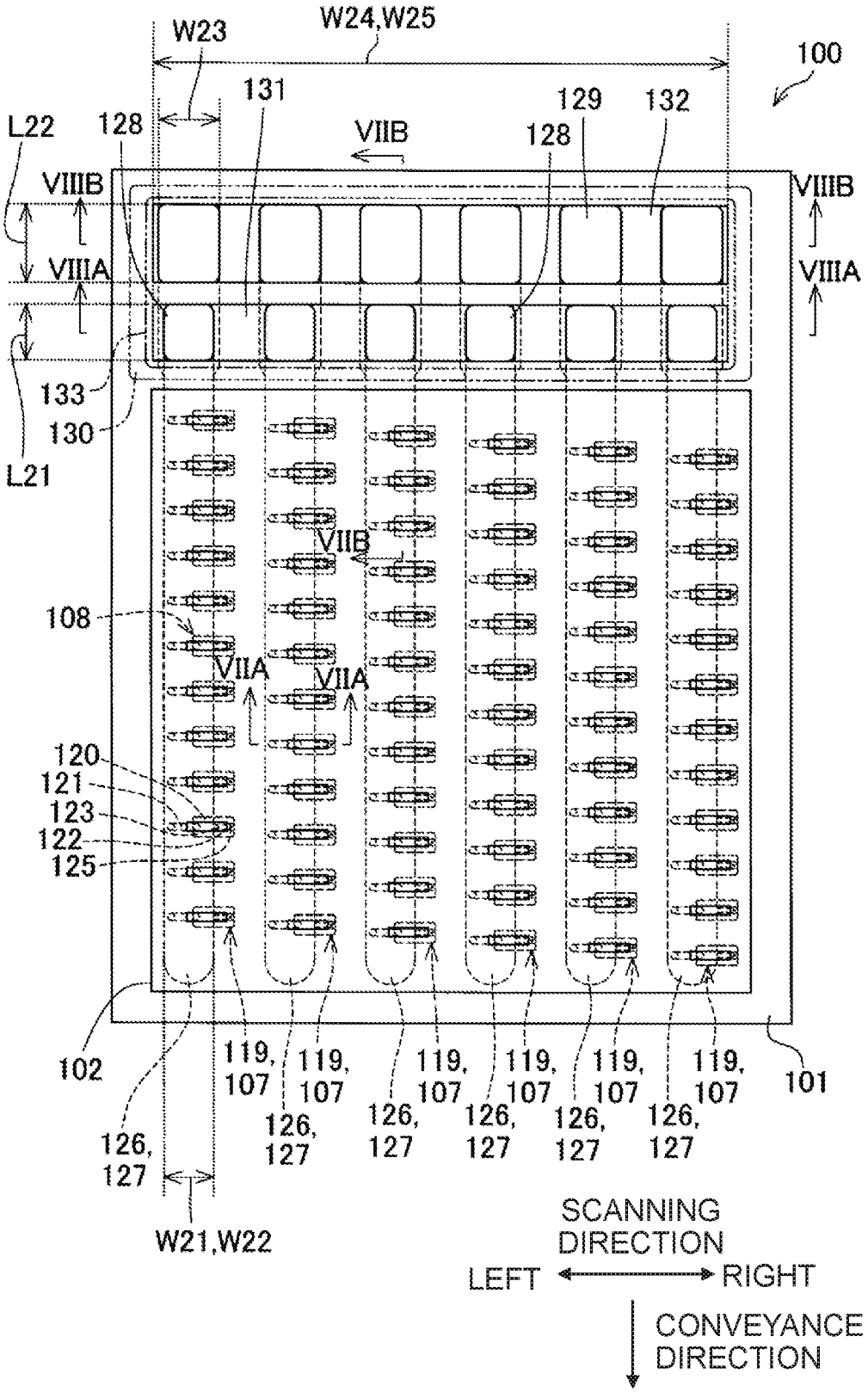
FIG. 6 is a plan view of an ink jet head according to a second embodiment of the present teaching.
Figure 7A:
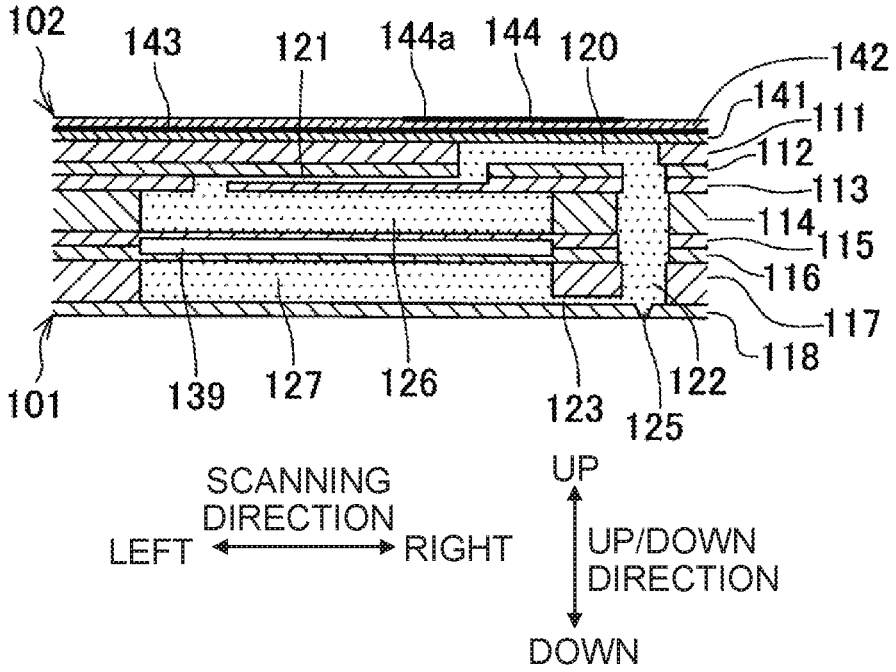
FIG. 7A is a cross-sectional view along the line VIIA-VIIA of FIG. 6.
Figure 7B:
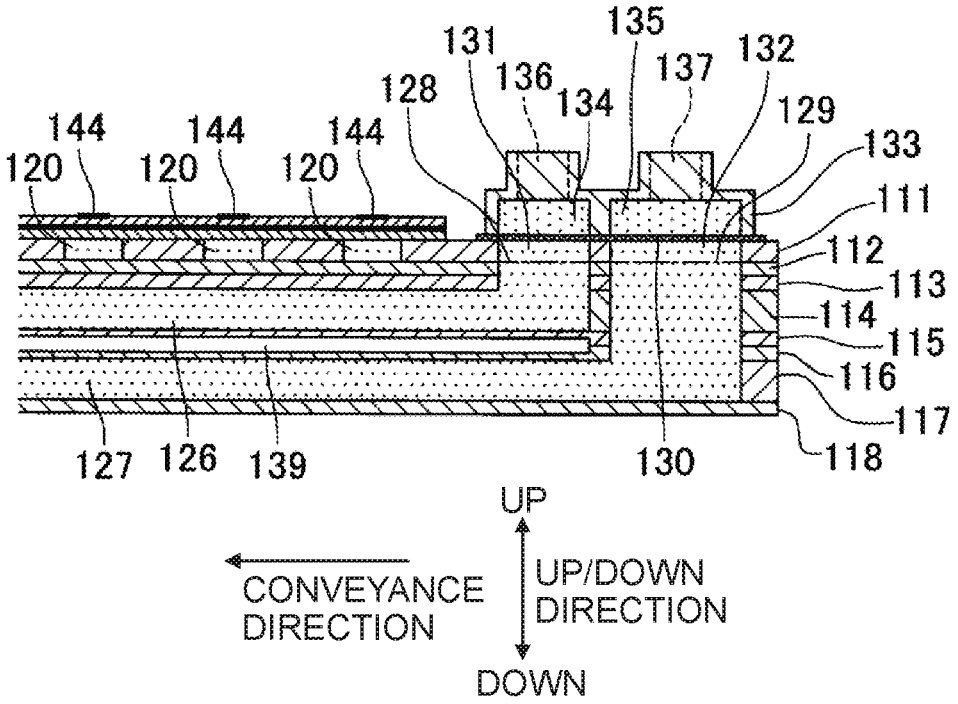
FIG. 7B is a cross-sectional view along the line VIIB-VIIB of FIG. 6.
Figure 8A:
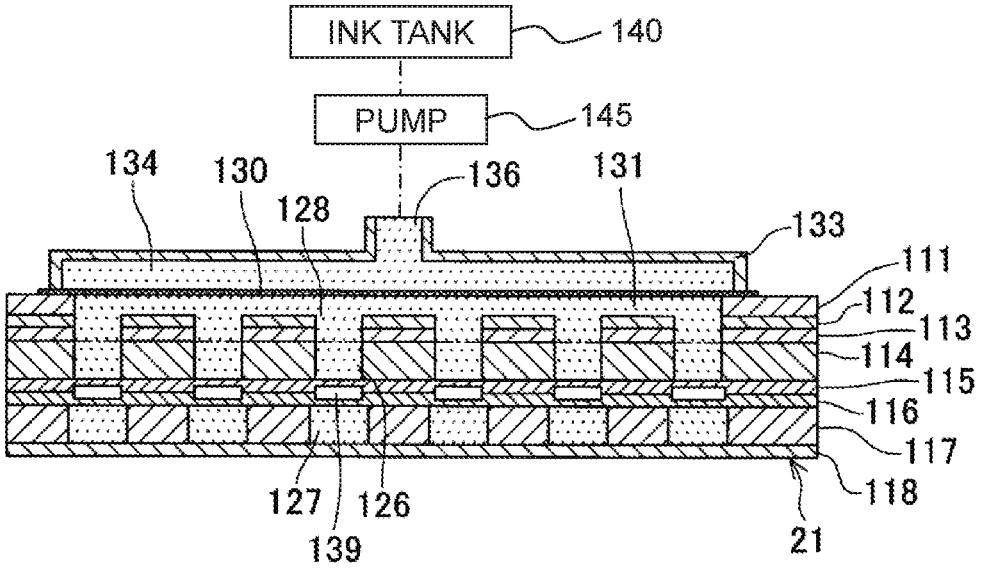
FIG. 8A is a cross-sectional view along the line VIIIA-VIIIA of FIG. 6.
Figure 8B:
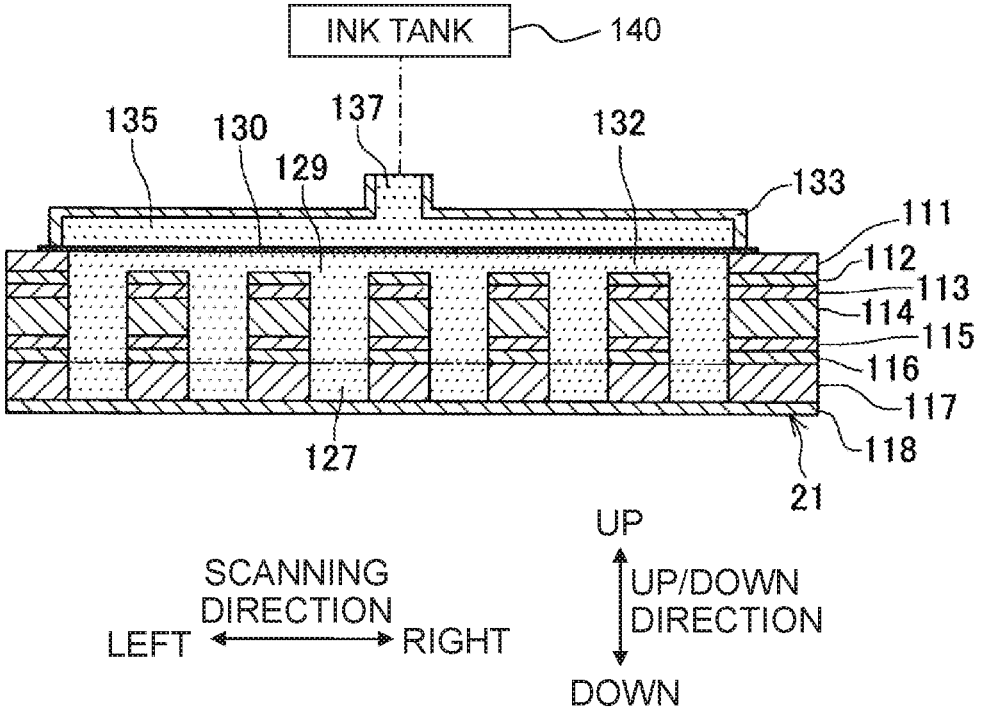
FIG. 8B is a cross-sectional view along the line VIIIB-VIIIB of FIG. 6.

Above the inflow ports 323, a common inflow channel 325 is provided to extend in the scanning direction across the four inflow ports 323 and connect the inflow ports 323 with each other. Above the outflow ports 324, a common outflow channel 326 is provided to extend in the scanning direction across the three outflow ports 324 and connect the outflow ports 324 with each other. A filter member 327 covers the upper ends of the common inflow channel 325 and the common outflow channel 326. Above the common inflow channel 325 and the common outflow channel 326 covered by the filter member 327, a channel member 328 is arranged. The channel member 328 is such a member as symmetrical to the channel member 53 with respect to the conveyance direction. Then, the common inflow channel 325 and the common outflow channel 326 are connected respectively with the ink tank 71 (see FIGS. 5A and 5B) through the channels and the like inside the channel member 328.

In the second modified embodiment, the ink flows into the supply manifolds 321 from both sides along the conveyance direction. Further, when the ink is jetted from a large number of nozzles, the ink flows into the feedback manifolds 322 from both sides along the conveyance direction. By virtue of this, in the second modified embodiment, it is possible to more reliably prevent shortage of the ink supply to the ink jet head 320.

Further, in the second modified embodiment, because the inflow ports 323 and the outflow ports 324 are arranged to deviate along the conveyance direction, it is possible to connect the inflow ports 323 with each other through the common inflow channel 325 of a simple structure extending in the scanning direction. Further, it is possible to connect the outflow ports 324 with each other through the common outflow channel 326 of a simple structure extending in the scanning direction.

Further, the above explanation was made with the examples where the present teaching was applied to ink jet heads in which the ink was circulated between an ink tank and an ink jet head. However, without being limited to that, as described in FIG. 4 of Japanese Patent Application Laid-open No. 2015-182253, for example, in an ink jet head without feedback manifold channels, according to the ink of each color, the ink supply ports (the "first connecting port" and/or the "second connecting port" of the present teaching) may be positioned to deviate along the conveyance direction.

Further, the above explanation was made with the examples where the present teaching was applied to ink jet heads jetting ink from nozzles. However, without being limited to that, it is also possible to apply the present teaching to other liquid jetting apparatuses than ink jet heads, which jet other liquids than inks from the nozzles.

What is claimed is:

1. A liquid jetting apparatus comprising:

individual channel rows each formed by at least three individual channels, the at least three individual channels being aligned in a first direction and including nozzles respectively, the individual channel rows being arranged in a second direction orthogonal to the first direction;

first manifolds each extending in the first direction and connected to the at least three individual channels forming the individual channel rows, the first manifolds being arranged in the second direction;

at least one second manifold extending in the first direction and connected to the at least three individual channels forming the individual channel rows;

first connecting ports formed in end portions, of the first manifolds, on one side in the first direction, the first connecting ports opening on one side in a third direction orthogonal to both the first direction and the second direction;

a second connecting port formed in an end portion, of the at least one second manifold, on the one side in the first direction, the second connection port opening on the one side in the third direction, the first connecting ports and the second connecting port arranged to be shifted in the first direction; and a first common channel extending in the second direction and connected to the first connecting ports of the first manifolds.

2. The liquid jetting apparatus according to claim 1, wherein the first manifolds are supply manifolds in each of which liquid flows from the one side toward the other side along the first direction and flows into the at least three individual channels, the at least one second manifold is a feedback manifold into which the liquid flows from the at least three individual channels and in which the liquid flows from the other side toward the one side along the first direction, the first connecting ports are inflow ports through which the liquid flows into the supply manifolds respectively, and the second connecting port is an outflow port through which the liquid flows out from the feedback manifold.

3. The liquid jetting apparatus according to claim 2, wherein the feedback manifold is arranged between two of the supply manifolds which are adjacent in the second direction.

4. The liquid jetting apparatus according to claim 3, wherein the first common channel is a common inflow channel extending in the second direction and connected to the inflow ports of the supply manifolds.

5. The liquid jetting apparatus according to claim 2, wherein the at least one second manifold is formed as feedback manifolds including the feedback manifold, the second connecting port is formed as outflow ports including the outflow port, and the liquid jetting apparatus further comprises a common outflow channel extending in the second direction and connected to the outflow ports of the feedback manifolds.

6. The liquid jetting apparatus according to claim 5, wherein the first common channel is a common inflow channel extending in the second direction and connected to the inflow ports of the supply manifolds, and a ratio between a length of the common inflow channel along the first direction and a length of the common outflow channel along the first direction is equal to a ratio between a number of the supply manifolds and a number of the feedback manifolds.

7. The liquid jetting apparatus according to claim 5, wherein the supply manifolds and the feedback manifolds are arranged alternately in the second direction.

8. The liquid jetting apparatus according to claim 7, wherein a number of the supply manifolds is one more than a number of the feedback manifolds and, among the supply manifolds and the feedback manifolds arranged alternately in the second direction, outermost two manifolds are the supply manifolds.

9. The liquid jetting apparatus according to claim 8, wherein a ratio between a sum of cross-sectional areas, of the supply manifolds, orthogonal to the first direction and a sum of cross-sectional areas, of the feedback manifolds, orthogonal to the first direction is equal to a ratio between the number of the supply manifolds and the number of the feedback manifolds.

10. The liquid jetting apparatus according to claim 5, wherein the first common channel is a common inflow channel extending in the second direction and connected to the inflow ports of the supply manifolds, and a cross-sectional area, of the common inflow channel, orthogonal to the third direction is larger than a cross-sectional area, of the common outflow channel, orthogonal to the third direction.

11. The liquid jetting apparatus according to claim 10, wherein the common inflow channel has the same length in the second direction as the common outflow channel, and has a larger length in the first direction than the common outflow channel.

12. The liquid jetting apparatus according to claim 5, wherein the supply manifolds and the feedback manifolds overlap with each other respectively in the third direction.

13. The liquid jetting apparatus according to claim 12, wherein each of the at least three individual channels includes:

a pressure chamber arranged on the one side in the third direction with respect to one of the nozzles and connected to one of the supply manifolds;

a connecting channel connected to the pressure chamber and being extended in the third direction from a connected part connected to the pressure chamber toward the one of the nozzles; and a circulation channel connecting a midway part of the connecting channel and one of the feedback manifolds.

14. The liquid jetting apparatus according to claim 12, wherein the supply manifolds are positioned on the one side in the third direction with respect to the feedback manifolds, and the outflow ports are positioned on the one side in the first direction with respect to the inflow ports.

15. The liquid jetting apparatus according to claim 14, wherein each of the supply manifolds has a first connected part connected to an individual channel which is nearest to the end portion, of each of the supply manifolds, on the one side in the first direction, each of the feedback manifolds has a first connected part connected to the individual channel which is nearest to the end portion, of each of the feedback manifolds, on the one side in the first direction, and a cross-sectional area of a part, of each of the feedback manifolds, on the one side in the first direction with respect to the first connected part of each of the feedback manifolds is larger than a cross-sectional area of a part, of each of the supply manifolds, on the one side in the first direction with respect to the first connected part of each of the supply manifolds.

16. The liquid jetting apparatus according to claim 14, wherein the first common channel is a common inflow channel extending in the second direction and connected to the inflow ports of the supply manifolds, and a cross-sectional area, of the common outflow channel, orthogonal to the third direction is larger than a cross-sectional area, of the common inflow channel, orthogonal to the third direction.

17. The liquid jetting apparatus according to claim 16, wherein the common outflow channel has the same length in the second direction as the common inflow channel, and has a larger length in the first direction than the common inflow channel.

18. The liquid jetting apparatus according to claim 2, wherein the inflow ports are positioned on the one side in the first direction with respect to the outflow port.

19. The liquid jetting apparatus according to claim 18, wherein each of the supply manifolds has a first connected part connected to an individual channel which is nearest to the end portion, of each of the supply manifolds, on the one side in the first direction, the feedback manifold has a first connected part connected to the individual channel which is nearest to the end portion, of the feedback manifold, on the one side in the first direction, and a cross-sectional area of a part, of each of the supply manifolds, on the one side in the first direction with respect to the first connected part of each of the supply manifolds is larger than a cross-sectional area of a part, of the feedback manifold, on the one side in the first direction with respect to the first connected part of the feedback manifold.

20. The liquid jetting apparatus according to claim 1, wherein the at least one second manifold is a supply manifold in which liquid flows from the one side toward the other side along the first direction and flows into the at least three individual channels, the first manifolds are feedback manifolds into which the liquid flows from the at least three individual channels and in each of which the liquid flows from the other side toward the one side along the first direction, the second connecting port is an inflow port through which the liquid flows into the supply manifold, and the first connecting ports are outflow ports through which the liquid flows out from the feedback manifolds respectively.

21. The liquid jetting apparatus according to claim 20, wherein the supply manifold is arranged between two of the feedback manifolds which are adjacent in the second direction.

22. The liquid jetting apparatus according to claim 1, further comprising a first filter preventing foreign substances from flowing into the first manifolds, and a second filter preventing foreign substances from flowing into the at least one second manifold.

23. The liquid jetting apparatus according to claim 22, wherein the at least one second manifold is formed as second manifolds, the second connecting port is formed as second connecting ports, the liquid jetting apparatus further comprises:

a second common channel extending in the second direction and connected to the second connecting ports of the second manifolds, the first common channel and the second common channel being open in an identical plane, and one filter member, which integrates the first filter and the second filter, that extends on the identical plane across the first common channel and the second common channel.

24. The liquid jetting apparatus according to claim 22, wherein the first connecting ports and the second connecting port are open in an identical plane, and the liquid jetting apparatus further comprises one filter member, which integrates the first filter and the second filter, extends on the identical plane across the first connecting ports and the second connecting port.

25. The liquid jetting apparatus according to claim 1, wherein third connecting ports are formed in another end portions, of the first manifolds, on the other side in the first direction, the third connecting ports opening on the one side in the third direction, and the liquid jetting apparatus further comprises a fourth connecting port formed in another end portion, of the second manifold, on the other side in the first direction, the fourth connecting port opening on the one side in the third direction, and the third connecting ports and the fourth connecting port are arranged to be shifted in the first direction.

* * * * *